US009982454B2

(12) United States Patent
Knudsen

(10) Patent No.: US 9,982,454 B2
(45) Date of Patent: May 29, 2018

(54) POST SLEEVE ASSEMBLY

(71) Applicant: N. Eric Knudsen, Maple Valley, WA (US)

(72) Inventor: N. Eric Knudsen, Maple Valley, WA (US)

( * ) Notice: Subject to any disclaimer, the term of this patent is extended or adjusted under 35 U.S.C. 154(b) by 0 days. days.

(21) Appl. No.: 15/178,375

(22) Filed: Jun. 9, 2016

(65) Prior Publication Data

US 2017/0044790 A1 Feb. 16, 2017

Related U.S. Application Data

(63) Continuation of application No. 14/603,150, filed on Jan. 22, 2015, now abandoned, which is a (Continued)

(51) Int. Cl.

| | |
|---|---|
| ***E04H 12/22*** | (2006.01) |
| ***E02D 27/42*** | (2006.01) |
| ***E02D 5/60*** | (2006.01) |
| ***E04B 1/92*** | (2006.01) |
| ***E04C 3/30*** | (2006.01) |
| ***E04F 19/00*** | (2006.01) |
| ***E01F 9/627*** | (2016.01) |

(52) U.S. Cl.

CPC ..... *E04H 12/2292* (2013.01); *E01F 9/627* (2016.02); *E02D 5/60* (2013.01); *E02D 27/42* (2013.01); *E04B 1/92* (2013.01); *E04C 3/30* (2013.01); *E04F 19/00* (2013.01); *E04H 12/2215* (2013.01); *E04H 12/2269* (2013.01)

(58) Field of Classification Search

CPC ..... E04H 12/2292; E04H 12/2269; E04H 12/2215; E04C 3/30; E04B 1/92; E02D 27/42

See application file for complete search history.

(56) References Cited

U.S. PATENT DOCUMENTS

| | | | |
|---|---|---|---|
| 978,505 | A | 12/1910 | Stewart |
| 1,224,926 | A | 5/1917 | Hindmarsh |

(Continued)

FOREIGN PATENT DOCUMENTS

| | | | |
|---|---|---|---|
| AT | 402 310 | B | 4/1997 |
| EP | 0 153 545 | A1 | 9/1985 |

(Continued)

*Primary Examiner* — Patrick J Maestri

(74) *Attorney, Agent, or Firm* — Seed IP Law Group LLP

(57) ABSTRACT

A post sleeve includes a reinforced concrete body preformed around a liner that defines a cavity extending longitudinally within the body, sized to receive a post. Standoff ribs run lengthwise within the cavity and extend inward from inner walls of the cavity. A post in the cavity is supported laterally by the standoff ribs. Drain channels between the ribs permit water to flow past the post and exit the cavity via a lower aperture. A drain tube is coupled to the lower aperture, and extends downward where it is covered with gravel at the bottom of a post hole. Concrete is poured around the post sleeve in the hole. The cavity is adaptable to receive posts of varying sizes, and at various depths. A collar closes a space between the post and the top of the cavity, permitting air circulation within the cavity while shedding water and substantially preventing insects from entering the cavity.

17 Claims, 17 Drawing Sheets

Related U.S. Application Data continuation of application No. 13/195,714, filed on Aug. 1, 2011, now Pat. No. 9,234,365, which is a continuation of application No. 12/163,506, filed on Jun. 27, 2008, now Pat. No. 8,011,149.

(56) References Cited

U.S. PATENT DOCUMENTS

| | | | | |
|---|---|---|---|---|
| 1,906,706 | A | 5/1931 | Moore | |
| 2,028,680 | A | 1/1936 | Mayeda et al. | |
| 2,684,518 | A | 7/1954 | Whitlock | |
| 2,712,467 | A | 7/1955 | Rice | |
| 3,192,292 | A | 6/1965 | Banks | |
| 3,265,349 | A | 8/1966 | Hamrick | |
| 3,346,230 | A | 10/1967 | Tolf, Jr. | |
| 3,638,433 | A | 2/1972 | Sherard | |
| 3,638,741 | A | 2/1972 | Zizak | |
| 3,824,748 | A | 7/1974 | Pichowicz | |
| 3,837,127 | A | 9/1974 | McMichael et al. | |
| 3,876,970 | A | 4/1975 | Schweitzer | |
| 3,894,589 | A | 7/1975 | Ciraud | |
| 4,077,599 | A | 3/1978 | Oland | |
| 4,079,912 | A | 3/1978 | Haydock | |
| 4,133,154 | A | 1/1979 | Ruzicka | |
| 4,479,342 | A | 10/1984 | Eberle | |
| 4,515,271 | A | 5/1985 | Auciello et al. | |
| 4,634,316 | A | 1/1987 | Cemak et al. | |
| 4,688,969 | A | 8/1987 | Bruser et al. | |
| 4,726,561 | A | 2/1988 | Worzala, Jr. | |
| 4,773,195 | A | 9/1988 | Waller | |
| 4,787,601 | A | 11/1988 | Rybak | |
| 4,850,440 | A | 7/1989 | Smet | |
| 4,874,149 | A | 10/1989 | Miceli | |
| 4,926,785 | A | 5/1990 | Lamson | |
| 4,986,373 | A | 1/1991 | Charland et al. | |
| 5,040,251 | A | 8/1991 | Hanford | |
| 5,090,165 | A | 2/1992 | Kenny | |
| 5,090,656 | A | 2/1992 | Brown | |
| 5,156,755 | A | 10/1992 | Cass | |
| 5,165,663 | A | 11/1992 | Wells | |
| 5,315,796 | A | 5/1994 | Gruhlke | |
| 5,339,909 | A | 8/1994 | Jenne et al. | |
| 5,405,119 | A | 4/1995 | Maguire | |
| 5,491,905 | A | 2/1996 | Jablonski et al. | |
| 5,492,429 | A | 2/1996 | Hodges | |
| 5,542,481 | A | 8/1996 | Scott | |
| 5,632,464 | A * | 5/1997 | Aberle | E01F 9/685 248/530 |
| 5,752,349 | A | 5/1998 | Fitzsimmons et al. | |
| 5,913,778 | A | 6/1999 | Hying et al. | |
| 5,961,249 | A | 10/1999 | Hansen et al. | |
| 5,992,103 | A | 11/1999 | Norman et al. | |
| 6,041,559 | A * | 3/2000 | Schickert | A63B 71/028 248/156 |
| 6,073,416 | A | 6/2000 | Peter | |
| 6,098,351 | A | 8/2000 | Mills | |
| 6,098,353 | A | 8/2000 | Stanfield | |
| 6,267,688 | B1 | 7/2001 | Morelli, Sr. | |
| 6,273,657 | B1 | 8/2001 | Vorona | |
| 6,293,028 | B1 | 9/2001 | Sylvia | |
| 6,308,926 | B1 | 10/2001 | Meyer | |
| 6,345,474 | B1 | 2/2002 | Triplett | |
| 6,389,760 | B1 | 5/2002 | McDonnell | |
| 6,658,753 | B2 | 12/2003 | Tatamic | |
| 6,860,029 | B2 | 3/2005 | Haynes | |
| 6,886,296 | B1 | 5/2005 | John et al. | |
| 6,991,413 | B2 | 1/2006 | Ballou et al. | |
| 7,003,919 | B2 | 2/2006 | Riker | |
| 7,055,807 | B2 | 6/2006 | Pesta | |
| 7,134,636 | B2 | 11/2006 | Callies | |
| 7,185,461 | B2 | 3/2007 | Lapointe et al. | |
| 7,185,720 | B1 | 3/2007 | Menna | |
| 7,191,573 | B1 | 3/2007 | Newton, II | |
| 7,219,872 | B2 | 5/2007 | Walker | |
| 7,325,790 | B2 | 2/2008 | Lee | |
| 7,377,489 | B1 | 5/2008 | Houseman | |
| 7,484,311 | B2 | 2/2009 | Bommarito | |
| 7,621,098 | B2 | 11/2009 | Reinert, Sr. | |
| 7,726,037 | B1 | 6/2010 | Jordan | |
| 7,954,289 | B2 | 6/2011 | Evans | |
| 8,011,149 | B2 | 9/2011 | Knudsen | |
| 2001/0000548 | A1 | 5/2001 | Niehaus | |
| 2002/0007613 | A1 | 1/2002 | Gordin et al. | |
| 2002/0139069 | A1 | 10/2002 | Buffkin et al. | |
| 2003/0121223 | A1 | 7/2003 | Riker | |
| 2004/0134146 | A1 | 7/2004 | Brown | |
| 2004/0255481 | A1 | 12/2004 | Haynes | |
| 2005/0005468 | A1 | 1/2005 | Wixey | |
| 2005/0241263 | A1 | 11/2005 | Van Rijn | |
| 2006/0243808 | A1 * | 11/2006 | Burlando | G06K 19/06046 235/487 |
| 2007/0036938 | A1 | 2/2007 | Engelbrecht | |
| 2007/0119067 | A1 | 5/2007 | MacKey | |
| 2007/0187564 | A1 * | 8/2007 | McGuire | E02D 27/42 248/346.5 |
| 2009/0025332 | A1 | 1/2009 | Richards | |
| 2009/0090836 | A1 | 4/2009 | Harris | |
| 2009/0119941 | A1 | 5/2009 | Sentz | |
| 2009/0320396 | A1 | 12/2009 | Knudsen | |

FOREIGN PATENT DOCUMENTS

| | | | |
|---|---|---|---|
| KR | 10-0991886 | A | 11/2010 |
| WO | 2007/064235 | A1 | 6/2007 |
| WO | 2008/047151 | A1 | 4/2008 |

* cited by examiner

POST SLEEVE ASSEMBLY

RELATED APPLICATIONS

This application is a continuation of U.S. patent application Ser. No. 14/603,150, filed Jan. 22, 2015, which is a continuation of U.S. patent application Ser. No. 13/195,714, filed Aug. 1, 2011, now U.S. Pat. No. 9,234,365, which is a continuation of U.S. patent application Ser. No. 12/163,506, filed Jun. 27, 2008, now U.S. Pat. No. 8,011,149, all of which applications are hereby incorporated herein by reference in their entireties.

BACKGROUND

Technical Field

The embodiments of the present disclosure are related in general to the field of installation of supports for uprights of fences, traffic signs, real estate signage, etc., and in particular to post supports that can be permanently installed, and from which one post can be removed and another emplaced.

Description of the Related Art

Posts of various lengths and compositions are used in a wide range of applications, including supporting fences, traffic control signs, temporary structures, etc. Where a post is intended to be substantially permanent, it is often placed in a hole and anchored in a concrete footing to increase its cross section and hold it firmly in place. One problem that is commonly encountered in such situations is that posts, especially wooden posts, are subject to breakage, warpage, and decomposition. Replacing a post that has been anchored in concrete is difficult, wasteful, and unfriendly to the environment for reasons that include excessive use of natural resources and the generation of landfill material. The concrete footing must be removed from the ground in order to make room for the new post. This requires that a much larger hole must be dug around the concrete footing. In turn, this requires a much larger volume of concrete or re-compaction of the surrounding soil, to fill the hole around the new post and create the new footing in proper contact with undisturbed or adequately compacted soil.

One of the most common causes of deterioration in wooden posts is water trapped around the end of the post inside the concrete. For example, when the post is damp or wet for an extended period of time, the wood absorbs water and draws it by capillary action downward into the concrete footing. Water becomes trapped between the wood and the inside wall of the concrete, so that the end of the post remains wet even while the upper portion is dry. This is especially true in cases where the end of the post is completely encapsulated in concrete, preventing water from escaping through the bottom of the footing, in which case the majority of the water escapes only through the wicking action of the end grain of the post.

To reduce this problem, installers often pour several inches of gravel into the bottom of a post hole and place the post directly on the gravel before they pour concrete around it. This prevents the concrete from completely sealing up the bottom of the post by flowing under it, and thus provides a channel for water to escape into the gravel. However, this is only a partial solution. Often the drainage gravel is not fully compacted and settles, causing more need for repair and replacement. Furthermore, with this common method, it takes substantial time for water, once having entered the footing, to work its way all the way through the footing and out the bottom. If the post is subjected to frequent or extended wet periods, the end of the post inside the footing may remain constantly wet even though water continues to drain out the bottom. Additionally, because of the direct contact with the ground on the end of the post, water can move upward into the footing when the ground is wet due to the capillary or wicking effect of the end grain. This constant dampness encourages the growth of organisms that digest the wood fiber and eventually destroy the post, or in the case of steel, rusts the post away. Additionally, the bottom of the footing is substantially open to insects, which can enter unobstructed from the gravel below to attack and eat the post.

Furthermore, direct contact between concrete and some species of wood generates a reaction that promotes deterioration of the wood. This limits the species of wood that can be used for fence or sign posts where concrete footings will be used in direct contact with the post.

Another approach that is used to protect wood posts and other lumber in direct contact with the ground or with concrete is commonly referred to as pressure treating. In this process, protective chemicals are forced into an outer surface of the post under high pressure. The chemicals provide the post with protection from common funguses and other organisms that cause deterioration. Pressure treatment generally extends the useful life of a post by a factor of five to ten. However, the chemicals used in pressure treatment are often toxic to humans and non-target organisms, and can leach into the water supply. In other cases, the chemicals are highly corrosive, tending to cause corrosion in fasteners and structures that are attached thereto. An additional problem with pressure treatment is that the wood cannot generally be recycled when it is replaced, and should not be composted, because of the chemicals still present. This means that it must be deposited in a landfill which in turn is a result of the need to install a post in direct contact with the ground and or concrete.

A third approach to this problem is the use of prefabricated anchors or sleeves, i.e., pockets that are placed in the ground or anchored in a concrete footing. These anchors permit a post to be removed and replaced without requiring that the pocket itself be replaced. Some examples of such anchors are disclosed in the following U.S. patents, all of which are incorporated herein by reference in their entireties: U.S. Pat. No. 5,632,464; U.S. Pat. No. 6,098,353; and U.S. Pat. No. 7,325,790.

THE SEVERAL VIEWS OF THE DRAWINGS

DETAILED DESCRIPTION

Figure 1:
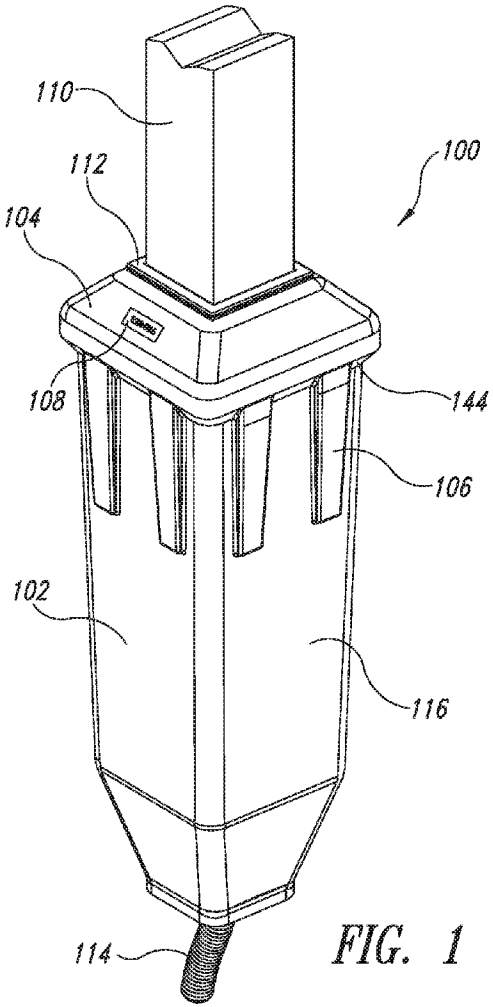
FIG. 1 is a perspective view of a post sleeve assembly according to an embodiment of the invention.

FIG. 1 shows a post sleeve assembly 100 according to a first embodiment. The post sleeve assembly 100 includes a post sleeve 102 having a body 116 with a somewhat tapered shape and a wide rim 104 extending outward from the body in each direction. Reinforcing ribs 106 extend from the body 116 to the underside or soffit 144 of the rim 104. A post 110 is shown positioned in the post sleeve 102. An upper surface of the rim 104 slopes downward, away from the post on all sides. An identification plate 108 is inset into an upper surface of the rim 104. A post collar 112 fits closely around the post and extends partway into an upper aperture 121 (see FIG. 2) of the post sleeve 102 providing a means to block insects, debris, and direct rain from infiltrating while maintaining substantial airflow to the post sleeve assembly and giving lateral support to the post from the supporting post sleeve 102.

The rim 104 is shown as having a smooth regular surface. According to other embodiments, the rim 104 can have any of a variety of shapes and configurations. For example, it can be embossed or debossed with text or symbols, textured to resemble stone or brick, or provided with architectural detail to coordinate with other nearby elements. The material of the body can be colored to add architectural detail, to promote functionality, or provide decorative appeal. The identification plate 108 is provided with a unique identification number that is applied during fabrication, and serves to separately identify each post sleeve assembly 100.

Figure 2:
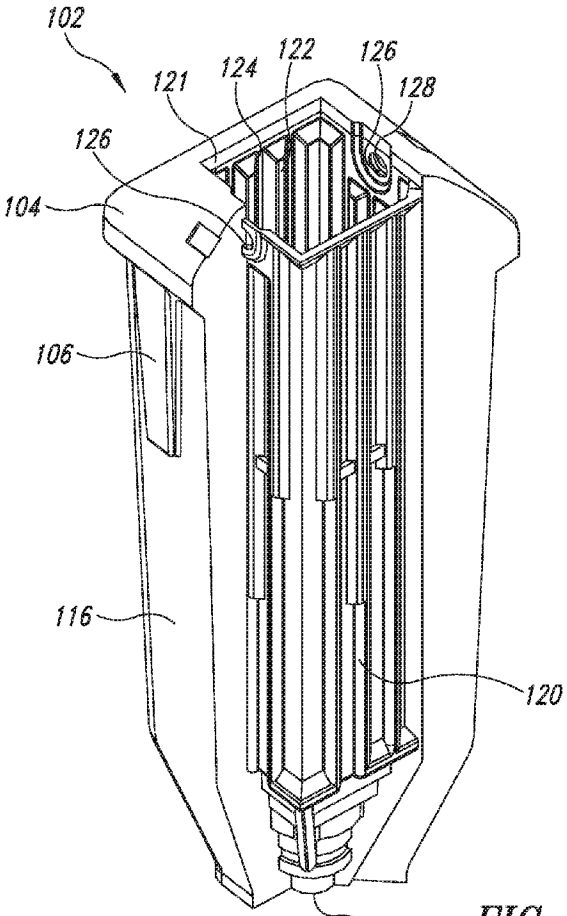
FIG. 2 shows a partial cutaway view of the post sleeve of the assembly of FIG. 1, showing a sleeve liner.

Turning now to FIG. 2, the post sleeve 102 is shown with a portion of the body 116 cut away to show details of the interior. A sleeve liner 120 is positioned within the body 116 and is substantially encapsulated therein. The sleeve liner defines a cavity 111 extending the length of the post sleeve, and configured to receive a post. The cavity 111 has an upper aperture 121 that is configured to receive a post, and a lower aperture 115 configured to provide drainage. Standoff ribs 122 are provided on inner walls of the cavity 111 with spaces between the standoff ribs 122 defining drain channels 124. The sleeve liner 120 includes a liner aperture 126, and the body 116 comprises an outer sleeve aperture 128 in a position that corresponds to the liner aperture 126 so as to be contiguous therewith and provide an aperture extending from the cavity 111 to the exterior of the post sleeve.

Figure 3:
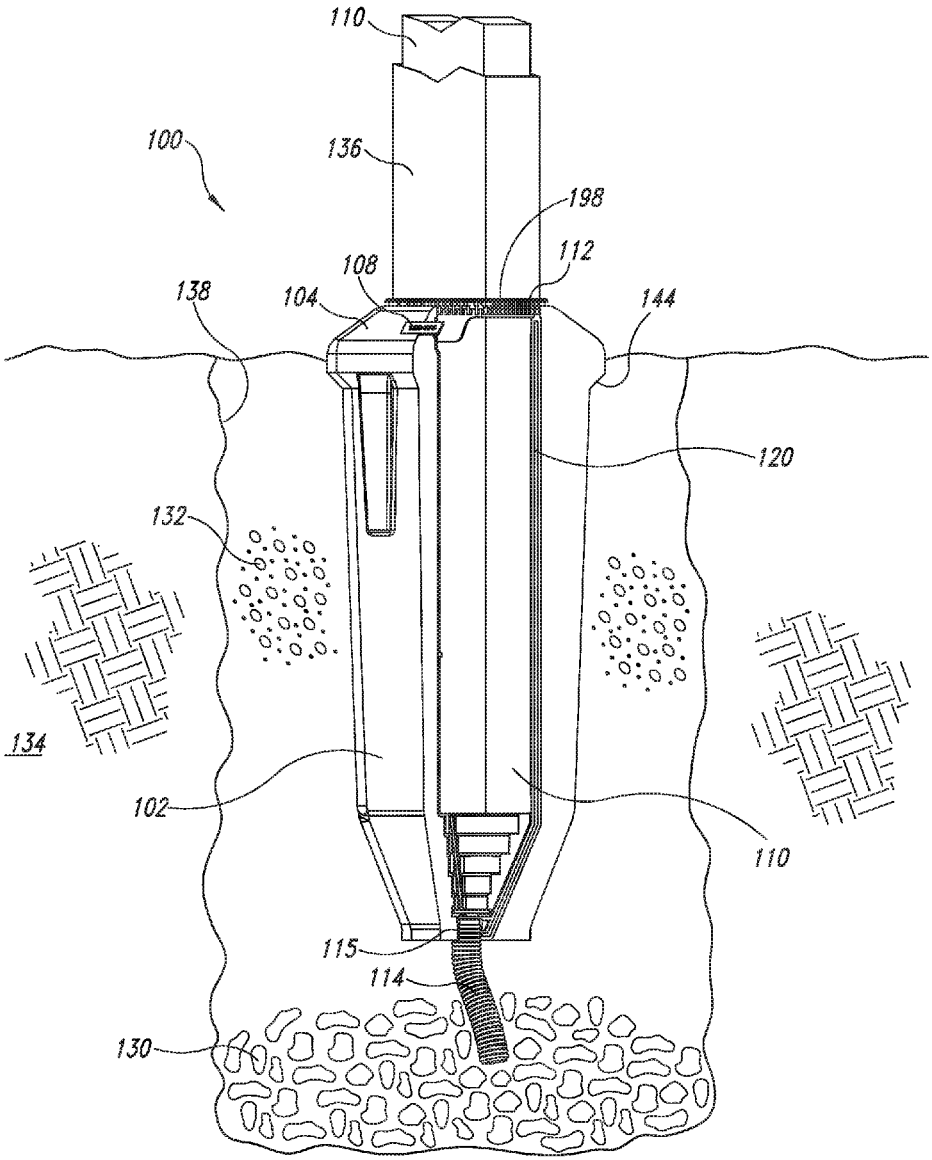
FIG. 3 shows the post sleeve assembly of FIG. 1 positioned in the ground as a finished footing.

According to the embodiment pictured, the post sleeve 102 is sized to receive a 4×4 post, of the kind that is widely used for fences and signs. When a 4×4 post is positioned in the post sleeve 102 (as shown in FIG. 3), it is supported on four sides by the standoff ribs 122, such that the post sleeve 102 functions as an extension of the post. While vertically oriented standoff ribs are shown and described, other standoff elements can be employed, such as diagonal ribs, short knobs extending within the cavity 111, etc., all of which fall within the scope of the invention.

The sleeve liner 120 is produced by injection molding or some other appropriate method of manufacture. The sleeve liner 120 is placed within a mold, and the body 116 of the post sleeve 102 is cast around the sleeve liner 120. The body 116 extends above the upper portion of the sleeve liner 120, which shields the plastic sleeve from long term exposure to UV rays, which can cause many plastics to deteriorate. The standoff ribs 122 contact and support the post 110 and prevent contact between the wood post and the concrete body 116, while the drain channels 124 allow water to drain away from the post and permit air ventilation to promote moisture evaporation.

In one embodiment, the body 116 is cast from a high strength concrete mix that includes glass fiber reinforcement and is formulated to have compression strength of 5,000 to 9,000 psi. It is formed to be highly resistant to most environmental and incidental wear and tear that such a structure is likely to be subjected to. Accordingly, it is anticipated that the post sleeve 102 will have a serviceable life span many times that of a typical wood post footing that is poured on site, and may exceed 50 years, perhaps reaching 100 years or more.

According to alternate embodiments, the body 116 and the sleeve liner 120 can be formed from any suitable material, including recycled plastic, metal, fiberglass, composite resin etc.

The identification plate 108 is shown as a metal (e.g., brass) plate that is embedded in the body 116 during the fabrication process. Alternatively, the identification plate 108 can be mounted to the body after fabrication, or the reference number can be formed in the material of the body 116, either on the rim 104 or inside the upper aperture 121, during the casting process.

FIG. 3 shows the post sleeve assembly 100 anchored in the ground 134 with a portion of the rim 104 extending above ground level. The rim 104 is configured to provide added lateral strength to the post and to reduce or prevent infiltration of water, debris and ground cover, as well as insects. Furthermore, it serves to protect the post from gardening tools such as edgers and string trimmers. The post sleeve 102 is positioned in a hole 138 in the ground 134. A layer 130 of compacted sand or drainage gravel is positioned at the bottom of the hole for drainage, and a poured concrete footing 132 surrounds and encases the post sleeve 102 in the hole 138. The concrete footing 132 adds cross sectional area for lateral support, depth for frost line resistance, and fills the hole between the post sleeve 102 and the undisturbed ground 134. As shown in FIG. 3, the post sleeve assembly 100 includes a flexible drain hose 114 coupled at a first end to the post sleeve 102 at the lower aperture 115, a second end thereof extending into the drainage gravel 130 at the bottom of the hole 138. The gravel functions as a dry well in which drainage from the flexible drain hose 114 accumulates, and from which water infiltrates to the surrounding soil. A plastic cover 136, such as is commonly used in vinyl fencing, is shown positioned over the post 110.

The post collar 112 includes a plurality of spacing ribs 198 distributed around a bottom surface thereof, which are shaped such that a portion of each of the spacing ribs 198 rests on an upper slightly outward sloped surface of the rim 104 of the post sleeve 102, with another portion extending into the upper aperture 121 of the post sleeve 102 between an inner surface of the post sleeve 102 and the post 110. In this way, the spacing ribs 198 serve to maintain a gap between the upper surface of the rim 104 and the lower surface of the post collar 112, providing ventilation while still allowing lateral support to the post by the post collar 112. The gaps between the spacing ribs 198 permit air to enter the post sleeve to assist in evaporation of moisture within the sleeve, but the post collar 112 is shaped to generally prevent water from entering the sleeve via the gaps between the spacing ribs 198. The spacing of the spacing ribs 198 is selected to prevent most insects from entering the post sleeve, including bees, hornets, and larger termites. The heating affect of the sun on the exposed concrete rim 104 creates a heat differential within the post sleeve 102 that generates convection within the cavity 111 to increase the airflow. Water that does enter the post sleeve 102 readily drains into the drainage gravel 130 via the flexible drain hose 114. Furthermore, as noted with reference to FIG. 2, the post 110 is separated from an inner wall of the post sleeve 102 by the plurality of standoff ribs 122 that define the internal dimensions of the cavity 111. The standoff ribs 122 of the embodiment pictured are sized and positioned to contact and support the outer surface of a common 4×4 post. Drain channels 124 extending lengthwise between the ribs in the post sleeve 102, permit water to flow easily out of the post sleeve and drain via the lower aperture 115 and the flexible drain hose 114, thereby preventing water from remaining in contact with the post 110 for extended periods. Top surfaces 123 of the standoff ribs 122 are tapered, permitting smooth post insertion during installation (see also FIG. 4).

According to an embodiment, the dimensions defined by the ribs 122 are slightly greater than the dimensions of a standard 4×4 post in order to accommodate a swollen or slightly bowed post. Alternatively or additionally, the material and thickness or shape of the innermost surfaces of the standoff ribs 122 of the sleeve liner 120 are selected to permit some resiliency to accommodate slight variations in size while adequately supporting the post.

The post sleeve assembly 100 helps to limit moisture damage to posts positioned therein in a number of ways. For example, water that strikes the post 110 runs down until it encounters the post collar 112, which diverts most of the water away from the post 110 and onto the upper surface of the rim 104 of the post sleeve 102. The water then flows down the sloped surface of the rim 104 and away from the post entirely. The limited amount of water that does enter the post sleeve 102 is generally channeled away from the post 110 by the drain channels 124 of the post sleeve liner 120 and runs to the bottom of the post sleeve 102, whence it exits via the flexible drain hose 114. Additionally, air circulation enabled by the gap under the post collar 112, and enhanced by convection and the normal flow of air around the post, further reduce the amount of moisture in the post sleeve 102.

The soffit 144 extends from an outer surface of the rim 104 to the lower portion of the body 116 of the post sleeve 102 at a substantial downward angle. When the post sleeve 102 is encapsulated in the concrete footing 132, as shown in FIG. 3, the angle of the soffit 144 allows the concrete to flow smoothly around the post sleeve 102 and fill in the spaces, which reduces the likelihood that air pockets will be trapped between the freshly mixed concrete footing 132 and the outer surface of the post sleeve 102. Typical poured-in-place concrete used for anchoring posts, such as that shown in the embodiment of FIG. 3, is more porous than concrete handled in a controlled manufacturing environment, such as the material used to form the post sleeve 102. Accordingly, water can percolate through the more porous concrete footing 132 and become trapped in air pockets alongside the body 116 of the post sleeve 102. If this occurs, there is a danger of cracking of the post sleeve 102 or the concrete footing 132 in the event the water freezes. The slanted surface of the soffit 144 reduces this danger. Additionally, the outer surface of the body 116 may be pre-treated with a concrete bonding agent to accelerate and perpetuate the bond of the lower strength concrete footing 132 to the body 116.

A poured-in-place concrete footing will typically have a psi rating in the range of 2,500 to 3,500 lbs. In contrast, concrete that is handled in a controlled manufacturing environment, with proper temperature control, vibration, mixing, and admixtures, such as the high strength material used to form the post sleeve 102, can easily reach a 5,000 to 9,000 psi rating, resulting in a hardened casing of extreme durability and life expectancy. The life expectancy of the relatively weaker poured-in-place concrete footing 132 is significantly increased by the post sleeve 102 because the substantially larger cross-sectional area of the post sleeve distributes and decreases the point load exerted under lateral loads by the narrower effective section of the post 110 itself.

Figure 4:
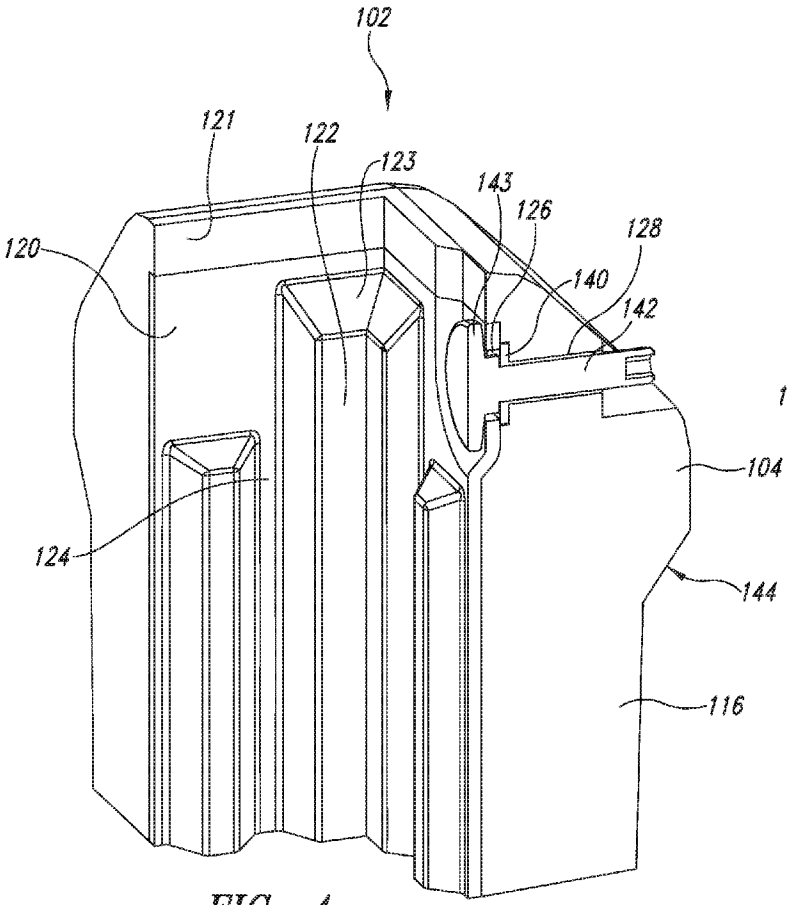

Turning now to FIG. 4, a detail of an upper portion of the post sleeve 102 and rim 104 is shown in cutaway view. FIG. 4 shows a fastener 142 extending from the interior of the post sleeve 102 to the exterior via the liner aperture 126 and the outer sleeve aperture 128. A threaded insert 140 is engaged by threads on the fastener 142. The fastener 142 extends into the interior of the post sleeve 102 and includes a pressure pad 143 on the end positioned within the post sleeve 102. When a post is positioned within the post sleeve 102, the fastener 142 is then driven in by rotation to engage a surface of the post collar 112, which transmits the pressure to the post, locking the post in the post sleeve 102. When removal of the post is necessary, one merely releases the fastener 142 and slides the post out of the post sleeve 102. In one embodiment, the threaded insert 140 is emplaced in the high strength concrete during the casting process, and is very securely attached. The material of the fastener is preferably a corrosion resistant material such as stainless steel and may be replaced as necessary when the post is removed.

According to an alternate embodiment, one or more apertures are provided from the exterior of the post sleeve 102, similar to the combined apertures 126, 128, and common fasteners, such as, for example, long deck screws, are driven into the post via the apertures, thereby securely anchoring the post to the post sleeve.

Figure 5:
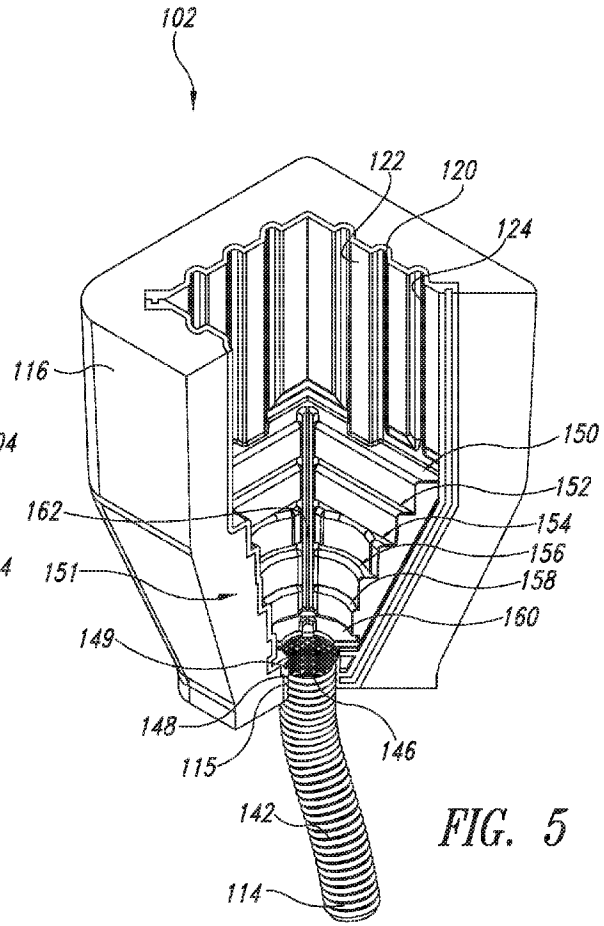
FIGS. 4 and 5 show respective details of the post sleeve assembly of FIG. 1 in cutaway view.

FIG. 5 is a cutaway view of a lower portion of the post sleeve 102, showing a universal socket section 151 comprising a plurality of sockets, including sockets configured for a number of the most common post shapes and dimensions. The sockets preferably have a slight taper in the sidewalls to allow for small variations in the dimensions of the post, including variations caused by surface treatments, swelling due to moisture, and slight manufacturing defects or tolerances in the actual dimensions of the posts. The reference characters in FIG. 5 that refer to the sockets indicate a respective step or ledge, but the socket indicated also includes sidewalls or other vertical elements to provide lateral support for a post.

Uppermost is the 4×4 socket 150, configured to receive a standard 3½×3½ inch fence post (nominally 4×4). The four sides of the 4×4 post are supported laterally by the standoff ribs 122 to hold the post snugly in place. The bottom end of the post rests on the ledge, or step, indicated by the reference number 150. A 3½ inch round post will also be accommodated in the 4×4 socket 150. Next is the 3 inch socket 152, configured to receive a standard 3 inch square post. The base of the post rests on the step indicated at reference number 152, and the four sides are supported by the side walls that extend upward from that step toward the 4×4 socket 150. The 2½ inch socket 154 is configured to receive a 2½ inch square post or a nominal 3 inch round post. The base of the post rests on the step indicated at reference number 154, and the four sides are supported by the side walls that extend upward from the step toward the 3 inch socket 152. Similarly, the (nominal) 2½ inch round socket 156, (nominal) 2 inch round socket 158, and 1⅝ inch round socket 160 are positioned one beneath the next as shown in FIG. 5, configured to receive round posts of tubing or pipe commonly used for fence and sign posts, railing balusters, etc. Additionally, the 2½ inch round socket 156 will also accommodate a 2 inch square post by providing bearing surfaces at the corners.

The socket sizes shown are merely exemplary, and do not limit the scope of the invention. For example, according to an embodiment, the post sleeve is provided with common metric-sized sockets for use where metric-sized posts are standard. Furthermore, the post sleeve is not limited to square and round sockets, or even to the most common sizes. It may be beneficial in some applications to provide rectangular or polygonal sockets for particular applications.

In the embodiment of FIG. 5, most of the standoff ribs 122 terminate above the bearing surface of the 4×4 socket 150, providing a drainage passage 162 for water to run to a corner of the sleeve liner 120, even when a 4×4 post is positioned in the 4 inch socket. Drain gutters 161 extend down the corners through each of the bearing surfaces and terminate above the lower aperture 115 to allow water to drain past the respective sockets and out the drain hose 114.

The flexible drain hose 114 shown in FIG. 5 comprises a plurality of annular ridges that create a flexible yet crush resistant pipe. Mating ridges 148 formed in the aperture 115 are sized to engage the ridges of the flexible drain hose 114, which is snapped into the aperture 115 to attach the flexible drain hose 114 to the sleeve liner 120. According to another embodiment, the lower aperture 115 is provided with a standard hose thread coupling. In other embodiments the lower aperture 115 may be a slip fit, press fit, snap fit, or any other loosely coupled means of providing a drainage port during the concrete pouring process for the concrete footing 132. It should be noted that a watertight seal between the flexible drain hose 114 and the lower aperture 115 is not necessary. The coupling need merely be sufficiently tight to prevent concrete from flowing into the lower aperture 115 during installation. Thus the tube can be any convenient tube, including a section of recycled garden hose, etc. The portion of the hose that will be buried in gravel can be provided with perforations to permit water to drain from the hose at various points to improve percolation. Alternatively, a length of soaker hose, such as is commonly used by gardeners to irrigate gardens, may be used in place of the flexible drain hose 114. It should be further recognized that the cross sectional area of the lower aperture 115 and accompanying flexible drain hose 114 can be as small or large as is deemed necessary for different conditions.

Figure 6:
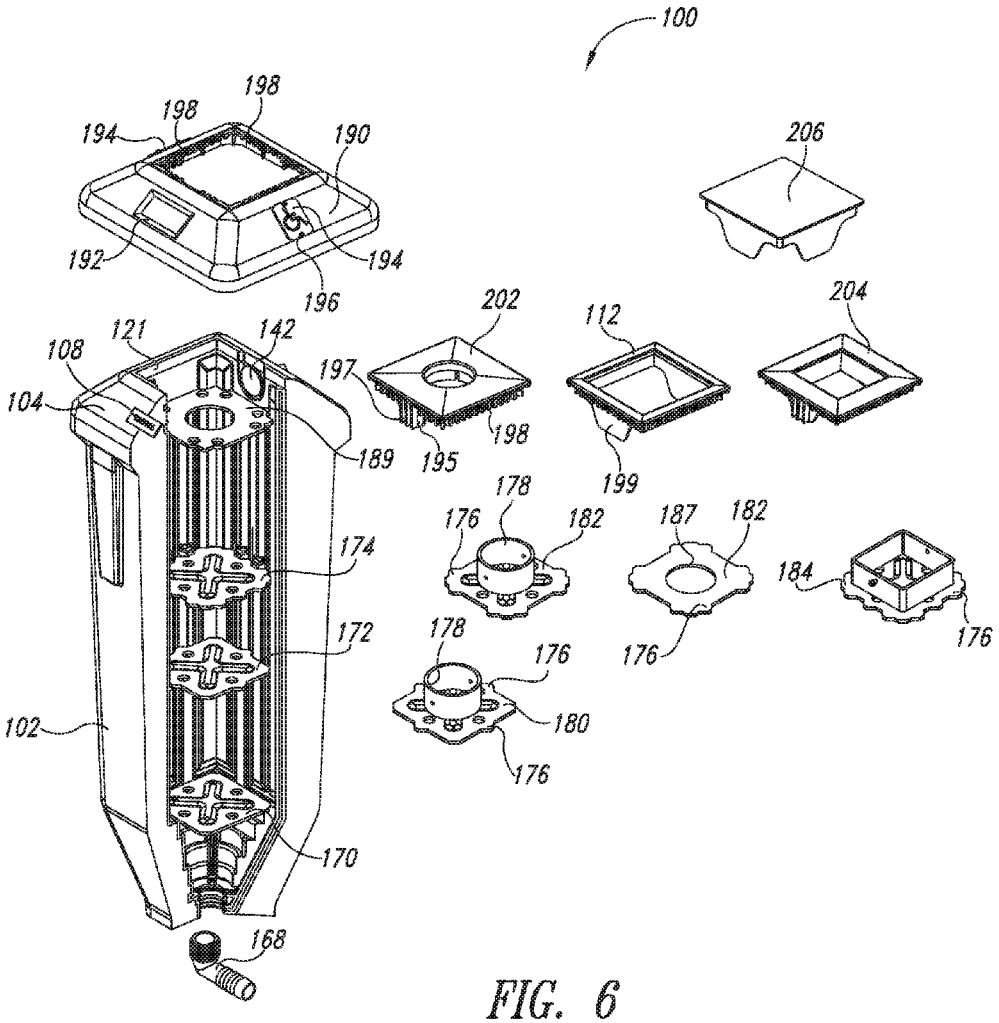
FIG. 6 is a cutaway view of the post sleeve assembly of FIG. 1 and a number of attachments and adapters for use with various post support configurations.

According to an embodiment, the lower aperture 115 sits directly on the gravel 130. Alternatively, a straight, rigid fitting is provided that extends directly down into the drainage gravel 130 below, which is advantageous where the footing is significantly longer than the post sleeve 102 to extend below a frost line. According to another embodiment, an elbow fitting 168, shown in FIG. 6, is provided to direct the flexible drain hose 114 into view from above during installation to simplify burying the flexible drain hose 114 in the drainage gravel 130. In some climates where freezing is a concern, post holes may need to be dug much deeper so that the concrete footing extends below the frost line to prevent uplift. As the installer can't physically reach to the bottom of the hole to insert the flexible drain hose 114 into the drainage gravel 130, the elbow fitting 168 can allow the installer to direct the hose into an opening provided in the sidewall of the hole 138 to assure a passage for water into the soil adjacent to the footing. It should be noted that the elbow 168 can be coupled by any appropriate method, including threaded coupling, glue, snap fitting, interference fitting, etc., and that the elbow fitting 168 and the flexible drain hose 114 can be one piece and of varying dimensions and flexibility.

A notch 149 is provided in the sleeve liner 120 above the lower aperture 115 to receive a replaceable corrosion resistant mesh screen 146 to prevent debris from accumulating in the flexible drain hose 114 over the life of the post sleeve 102. While the spacing ribs 198 of the post collar 112 will prevent most debris from entering, some will inevitably enter. Additionally, as the post ages and eventually deteriorates, wood fragments may also drop to the bottom of the sleeve. The mesh screen 146 prevents most debris from entering the flexible drain hose 114 and blocking the drainage of the post sleeve 102. While it is true that such debris may also block the lower aperture 115 from above the mesh screen 146, it is anticipated that prior to installing a new post, the installer will vacuum out the bottom of the post sleeve 102 as necessary, to remove any such blockage. This is a much simpler operation than cleaning the area below the lower aperture, which would otherwise be necessary. In the embodiment of FIG. 5, an additional notch is provided above the mesh screen 146 as an extension of the surface of the 1⅝ inch round socket 160. This additional notch acts as a receiver for a high pressure water nozzle with vacuum assembly to engage and blow out the area below the lower aperture 115, if necessary.

Referring now to FIG. 6, a post sleeve 102 is shown, together with a variety of elements for adapting the post sleeve to accommodate various sizes and shapes of posts, and for various applications. Stop plates 170, 172, 174, 180, 182, and 184, and support plates 186 and 189 are shown, and will be described in detail below. Additionally, post collar 112, described above with reference to FIG. 2, post collars 202 and 204, sleeve cap 206, and rim cap 190 are shown, all of which will also be described in detail below.

Provided the post is adequately supported laterally, it is not required that the post extend the full depth of the sleeve. Accordingly, stops are provided at various depths within the post sleeve 102 to permit the post to be supported at less than the full depth of the sleeve. Stops are most clearly shown in the embodiment of FIG. 7. In FIG. 6, the 4×4 socket 150 is 19 inches below the upper surface of the rim 104 of the post sleeve 102. 19 inch stop plate 170 is provided to rest on the ledge of the 4×4 socket 150, and is supported laterally by standoff ribs 122. 19 inch stop plate 170 is provided as support for a 4×4 wood post in heavy post applications such as, for example, extra tall fences or signs. The 19 inch stop plate 170 is substantially square, with notched corners, and holes 171 that serve to permit water to drain past. A raised surface portion in the center of the stop plate acting as a standoff 173, strengthens the plate and holds the bottom face of the post slightly away from the plate, allowing ventilation to the bottom-most surface of the wood post. As this is the end grain, or "wicking" surface, this is the most important portion to keep dry in order to prevent rot. The 19 inch stop plate 170 can be pre-installed to the bottom of the post prior to insertion by means of a screw through one or two of the drain holes 171, or it can be dropped into place from the top opening just prior to setting the post.

The first stops above the 4×4 socket 150 are the 13 inch stops 164, which are 13 inches below the upper surface of the rim 104. 13 inch stop plate 172 is provided, including a plurality of tabs 176 extending from the edges of the plate. When the 13 inch stop plate 172 is positioned in the post sleeve 102, the tabs extend into the drain channels 124, and engage the 13 inch stops as shown in FIG. 6. With the exception of the tabs 176, the 13 inch stop plate 172 is substantially identical to the 19 inch stop plate 170. Thus, the 13 inch stop plate 172 serves to support the bottom end of a 4×4 post 13 inches below the upper surface of the rim 104. In addition to the 13 inch stop plate 172, other plates, which will be discussed in detail later, are provided that are configured to engage the 13 inch stops.

9 inch stops 166 are provided 9 inches below the upper surface of the rim 104. 9 inch stop plate is provided with tabs 176 arranged to engage the 9 inch stops 166, as shown in FIG. 6. As with the 13 inch stop plate 172, the 9 inch stop plate 174 is also substantially identical to the 19 inch stop plate 170, excepting the tabs 176, and serves to support the bottom end of a 4×4 post 9 inches below the upper surface of the rim 104.

Figure 8:
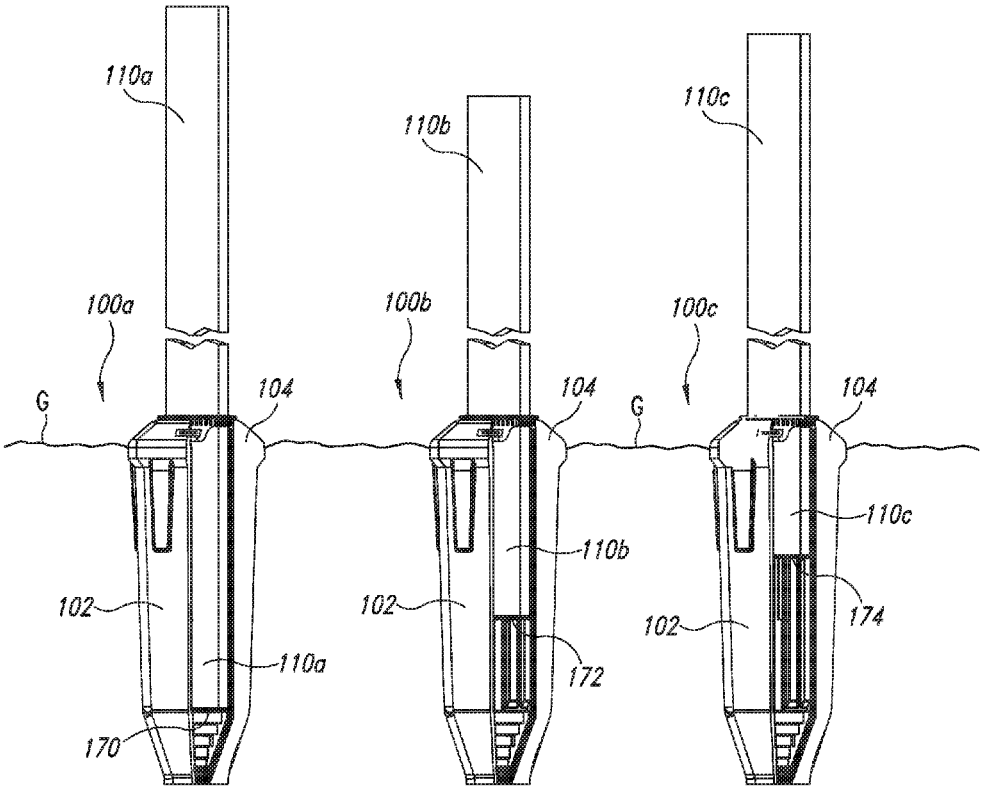
FIG. 8 shows three post sleeves in respective configurations according to an embodiment of the invention.

Referring to FIG. 8, three post sleeve assemblies 100 are shown in respective configurations: post sleeve assembly 100*a* includes an eight-foot post 110*a* supported by a 19 inch stop plate 170 at 19 inches below the top of the rim 104 of the assembly at the socket 150; post sleeve assembly 100*b* includes a seven-foot post 110*b* supported by a 13 inch stop plate 172 at 13 inches below the top of the rim 104 of the assembly; and post sleeve assembly 100*c* includes a seven-foot post 110*c* supported by a 9 inch stop plate 174 at 9 inches below the top of the rim 104 of the assembly.

Assuming that a fence of six feet in height is desired, eight-foot posts would normally be used, and set at a depth of about 18 to 24 inches, depending on how much of the post is to extend above the fence. Accordingly, the eight-foot post 110*a*, which is supported 19 inches below the rim 104 of the post sleeve assembly 100*a*, extends about 79 inches above ground level G, which is sufficient to accommodate most fence heights by trimming any excess from the post. However, by positioning a post as shown with reference to post sleeve assembly 100*b*, using a 13 inch stop plate 172 at the 13 inch stop, the post 110*b* extends six inches further above ground level G. Bearing in mind that the post sleeve 102 is to be installed with the upper surface of the rim 104 at about two inches above ground level for proper drainage, the top of the seven-foot post 110*b* is about 73 inches above ground level G, which will support a six-foot fence with one inch of clearance below. Accordingly, where an eight-foot post is normally required for a six-foot fence, a seven-foot post will serve if installed with a post sleeve and a 13 inch stop plate 172. Furthermore, by using the 9 inch stop plate 174 at the 9 inch stops 166, as shown with reference to post sleeve assembly 100*c*, the seven-foot post 110*c* extends an additional four inches above the post 110*b*. Thus, a six-foot fence can be built using post sleeves configured as shown with reference to post sleeve assembly 100*b* to support most of the posts, and the corner posts can be supported by post sleeves configured as shown with reference to post sleeve assembly 100*c* to provide additional height for the post cap to be properly placed, all without cutting any of the posts.

Furthermore, any portion of the interior of a post sleeve that lies below the bottom of the post serves as a reservoir to hold water until it can percolate into the gravel or soil below the post sleeve assembly. Thus, another desirable benefit of using plates like stop plates 172 or 174 and the stops 164,166 is that they create a larger drainage reservoir within the post sleeve 102 below the post and reduce the likelihood that standing water will contact the wicking end of the post. This is especially beneficial in climates with seasonal periods of high rain fall.

According to another embodiment, the drain channels 124 are tapered or stepped so that they are widest at the top of the post sleeve 102, and become narrower toward the bottom. Tabs on stop plates and other fittings have widths selected to engage the drain channels 124 at different heights. Thus, the position of a post within the sleeve is infinitely variable, according to the selected widths of the tabs of the stop plate employed.

Returning to FIG. 6, 13 inch stop plate 180, and 9 inch stop plates 182 and 184 are shown, provided with tabs 176 arranged to engage the 13 inch and 9 inch stops, respectively. 13 inch stop plate 180 is provided with tabs 176 arranged to engage the 13 inch stops 164, and with a 1⅝ inch socket 178 configured to receive a 1⅝ inch steel fence post. 9 inch stop plates 182 and 184 are each provided with tabs 176 arranged to engage the 9 inch stops. 9 inch stop plate 182 is provided with a 1⅞ inch round socket 178 configured to receive a 1⅞ inch steel fence post, while 9 inch stop plate 184 is provided with a 2½ inch square socket 185 configured to receive a 2½ inch square aluminum fence post. Additionally, 9 inch support plate 186 is shown, having tabs 176 arranged to engage the 9 inch stops. 9 inch support plate 186 includes an aperture 187 having a 1⅝ inch diameter. When a 1⅝ inch round post is positioned in the post sleeve 102, either in the 1⅝ inch socket 160 or in a stop plate such as the 13 inch stop plate 180, the post traverses the aperture 187 of the 9 inch support plate 186, which provides lateral support to the post. Finally, the upper support plate 189 is shown, provided with an aperture sized, in the pictured embodiment, to receive a 1⅝ inch round post, and configured to rest on the upper ends of the standoff ribs 122. The upper support plate 189 can be used with any length post to provide rigid lateral support near the top of the post sleeve 102.

Plates 170, 172, 174, 180, 182, 184, 186, and 189 are provided as examples only, to show a variety of plates configured to support fence posts of different sizes and shapes at various levels within the post sleeve 102, and to properly orient and support the posts in the x, y, and z axes. It will be recognized that many different configurations of stop plates and support plates can be employed for use at the 19, 13, or 9 inch levels, or any other desired levels, depending on the particular application.

The various plates described above can be inexpensively manufactured in large quantities through a wide variety of processes, including, for example, stamping or blanking. Alternatively, where a small number of non-standard plates is required, and the limited quantity of a given configuration does not justify the expense of preparing stamping dies, the plates can be made from an efficiently machinable material such as UHMW polyethylene. For example, plates with the appropriate apertures, tabs, sockets, etc., for many applications can be machined from sheets of inch UHMW polyethylene. One such plate is described later with reference to FIG. 12.

Figure 9:
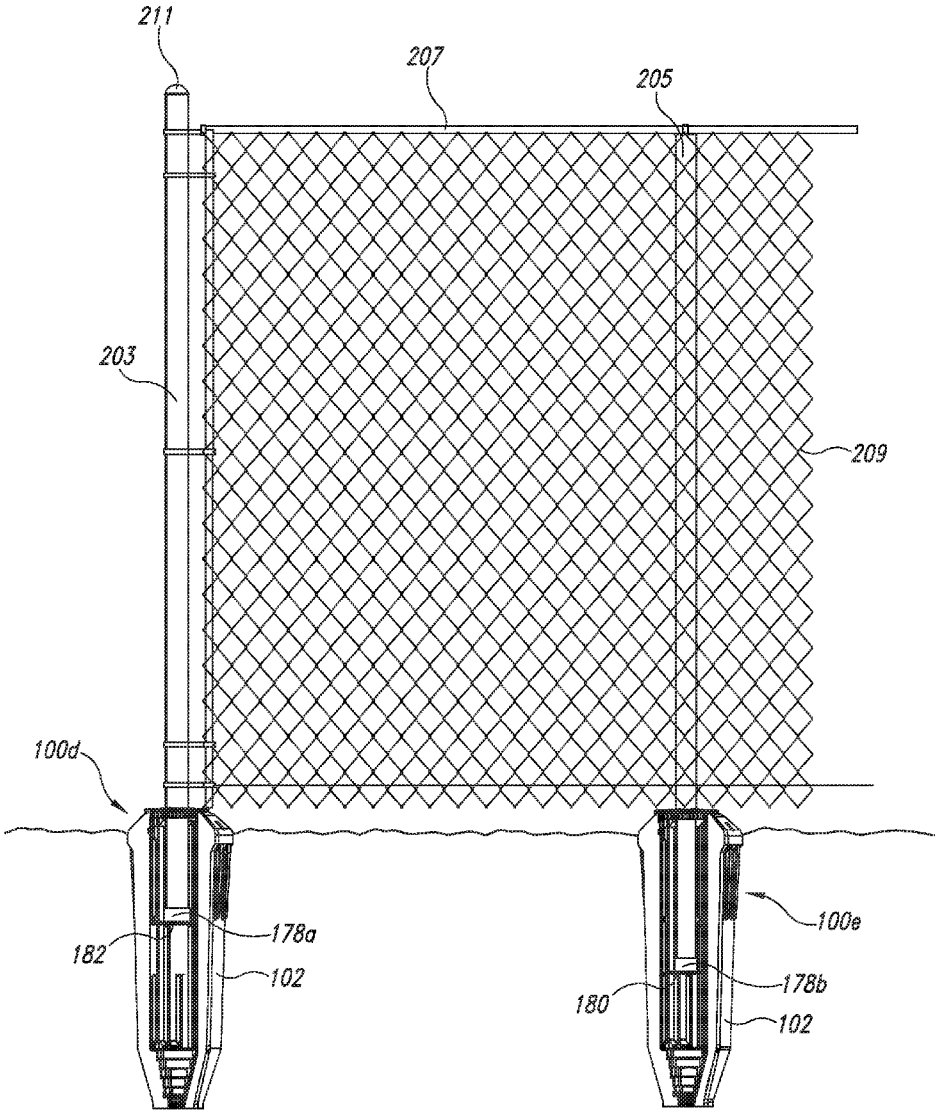
FIG. 9 shows a chain-link fence according to an embodiment.

As shown in FIG. 9, the spacing of the 13 inch and 9 inch stops 164, 166 is particularly advantageous with regard to chain link fencing. Typically, chain link fences are constructed using a combination of 1⅝ inch "line" posts, which are positioned along the run of the fence and have a horizontal tube member running along the tops for support, and 1⅞ inch "terminal" posts, which extend four inches above the line posts and typically have a rounded cap on top as a finish detail. The horizontal tube members that run along the top of the fence above the line posts tie into the sides of the terminal posts. Thus, it is necessary to provide an elevation difference of four inches between the smaller line posts and the larger terminal posts. The 13 and 9 inch stops 164,166 in the post sleeve 102 are spaced from the top of the post sleeve 102 in a manner that allows an industry standard 7 foot steel tube line post or terminal post to be placed in the post sleeve 102 obtaining the maximum amount of penetration while still allowing a workable height to construct a 6 foot chain link fence with no cutting of the tubes and no wasted material, and while still allowing the bottom of the 6 foot fence to clear the top rim 104 of the post sleeve 102.

FIG. 9 shows a first post sleeve assembly 100*d* with a stop plate 182 and a 1⅞ inch socket 178*a* at the 9-inch stops 166, supporting a 1⅞ inch terminal post 203 with a cap 211. A second post sleeve assembly 100*e* has a stop plate 180 and a 1⅝ inch socket 182*b* at the 13-inch stops 164, and supports a 1⅝ inch line post 205. A horizontal tube 207 extends from the terminal post 203 over the line post 205 and supports a section of chain link fencing 209. Because of the spacing between the stops 64 and 66 of the post sleeves 102, the tops of the line post 205 and terminal post 203 are properly spaced for the standard fence configuration, without the need to cut either post.

Returning again to FIG. 6, various embodiments of post collars are shown, as examples for use with different cross sections and sizes of posts. For example, post collar 112 is configured to accommodate a 4×4 square post, post collar 202 is configured to accommodate a 1⅞ inch round post, and post collar 204 is configured to accommodate a 2½ inch square tube. Of course, the post collars shown are merely exemplary; post collars can be provided to accommodate any post that the post sleeve 102 can receive. The material of the post collar is selectable according to the particular application. Furthermore, a flexible gasket can be positioned between the post and a post collar to provide additional protection from water that would otherwise run between the collar and the post.

Where a post is fully supported laterally within the sleeve by the standoff ribs 122 or by a support plate, the post collar may serve merely to provide a finished appearance and shed water. The post collar may also be configured to provide a degree of resilience or weakness, depending on the desired functionality. For example, according to an embodiment, a plastic post collar is provided for use with parking lot signs, such as "Handicap Only" parking signs, installed with a 2½ inch square tube. The collar is configured to repeatedly fail on impact by popping out of its aperture, only to be snapped in again with no damage, to save the post from—likely frequent—minor bumper impacts. In this way, with minor bumper impact, the plastic collar will pop out or break before the post itself bends or breaks, permitting the post to pivot on a 9 inch stop plate, for example, thereby saving the post and potentially the post collar.

Post collars are generally provided with spacing ribs 198 that hold the collars up off the angled top surface of the rim 104 and penetrate into the upper aperture 121 of the post sleeve 102, providing insect and debris resistant ventilation channels while also transmitting lateral load from the post to the internal face of the post sleeve 102. The spacing, thickness, and length of the spacing ribs 198 can be chosen to provide more or less lateral resistance to accommodate, for example, a breakaway model intended to protect a post.

Pressure tabs 199 are positioned so as to be engaged by the fastener 142 and transmit pressure from the fastener to the post to lock the post in position. Where the post collar is configured to support a post that is smaller than the 4×4 post size, an inner pressure tab 195 is provided, with extension ribs 197 or similar structures extending onto the inner pressure tab 195 to provide the necessary transition to be engaged by the fastener and to transmit the pressure to the post.

According to an alternate embodiment, the fastener is configured to engage the post directly. Where a smaller post is to be installed and direct contact with the post is desired, the standard fastener is removed, and a longer fastener is positioned in its place. The post is then installed in the post sleeve and the longer fastener is driven in to engage the post.

Sleeve cap 206 is configured to be positioned in the upper aperture 121 of the post sleeve 102 to close the upper aperture 121 during periods of non-use or between the time the post sleeve 102 is installed in the ground and a post is inserted. The sleeve cap 206 serves to prevent the introduction of rocks and debris into the post sleeve 102, and also to prevent injury to pedestrians or animals when not in use. Like the post collars, the sleeve cap can be constructed of any suitable material including, for example, steel, aluminum, and plastic.

In the embodiment of FIG. 6, rim cover 190 is constructed of UV resistant injection molded plastic, and can be any suitable color. The rim cover is configured to snap into place on the post collar 112 and rest over the rim 104 to provide a substrate for identification or information that is temporary, as compared to the expected life expectancy of the post sleeve 102, or that is added after the post sleeve 102 is manufactured. For example, in FIG. 6, a sign plate 194 with a handicap symbol is shown coupled to the rim cover 190 by fasteners 196, which can be rivets, screws, nuts and bolts, etc. Additionally, or alternatively, the surface of the rim cover can be directly marked using vinyl or screen printed images, or by engraving or embossing, for example.

It can be seen that the rim cover 190 provides a number of surfaces that can be used, for example, by the installation contractor to place a logo or contact information, or to identify the function of the post, as in the example pictured, or to provide a backup sign or an indication of the necessary replacement in the instance where the post becomes snapped off. Other examples of uses for the rim cover 190 are reflective address markings at the bases of posts supporting mail boxes for fire and rescue, reflective "Stop" with red plastic body color for "Stop Signs" and added visibility, "No Trespassing" warnings for property lines etc. Spacing ribs 191 provide clearance between the rim 104 and the rim cover 190 for the fasteners 196. The spacing ribs 198 extend to the aperture and line up with the spacing ribs 198 in the post collars to provide continuous air ventilation as described above.

The rim cover 190 comprises an aperture 192 in a position that corresponds to the position of the identification plate 108, such that when the rim cover 190 is coupled to the rim 104 of the post sleeve 102, the identification plate 108 is visible through the aperture 192. In those embodiments where the identification plate 108 is not employed, or where it is not required to be visible, an additional plate or cover can be snapped into the aperture 192.

The stops, stop plates, support plates, post collars, sleeve caps, and other elements described above with reference to FIG. 6 are shown and described merely as examples. It is within the abilities of one of ordinary skill in the art to provide such items with any dimensions or configuration or in any suitable material, as necessary for a given application.

The inventor has recognized that a particular problem in the fencing industry is that fences are often built from scratch on site, meaning adjoining segments of a fence may not be identical, and that, even where prefabricated fence panels are employed, many will be modified or customized to fit specific spans and angles between posts. When a portion of a fence is damaged or knocked down, it is generally necessary for a fence contractor to bring to the site all the materials necessary to re-fabricate the damaged portions of the fence, and often to reproduce a complex pattern using materials and equipment on hand, or, alternatively, to come to the site a first time to take measurements and patterns, then fabricate replacement panels and return to the site to install them.

According to one embodiment, the identification plate 108, described above with reference to FIGS. 1 and 2, is part of a system that addresses many of these problems. The identification plate 108 of each post sleeve is provided with a unique identification number that is affixed either during fabrication of the post sleeve or during installation. During installation of a new fence, the contractor records the unique identification numbers of each post sleeve, together with all the pertinent information about the fence, including the pattern, color, material, dimensions, etc. The location of each post sleeve is recorded, as well as the positioning of each sleeve relative to other sleeves, in the x, y, and z axes. The information is deposited in a central database maintained by the post sleeve manufacturer or an independent repository.

In the event a repair is required, the property owner makes note of the identification numbers of the post sleeves that are involved and contacts a contractor—either the original contractor, whose contact information may be provided on the rim or rim cap of at least one of the post sleeves, as described above, or another qualified contractor—and provides the identification numbers and a description of the damage. The contractor then accesses the database, via a secure website, for example, and obtains the details and dimensions of the fence design, and, more importantly, the specific details of the fence panels associated with the identification numbers provided by the property owner. The contractor can then fabricate the replacement fence sections in a shop to replace the damaged sections, to the precise dimensions and pattern of the original, then transport the completed sections and install them at the site. The property owner may, alternatively, choose to order the replacement sections and install them herself, without the assistance of a contractor. Even though the fence dimensions will vary from one span to the next, the identifying numbers on the post sleeves will provide the exact location with the exact dimensions. This saves considerable time and expense, as well as reducing waste, because material optimization is much easier in a controlled shop environment than in the field. Because the information is maintained at a central database, it can be accessed by the contractor or property owner, even if the original contractor is no longer in business.

Similar systems are provided, according to other embodiments, to track the location and details of commercial signs, traffic signs, guard rails, etc. If, for example, a traffic sign is damaged or deteriorated, an inspector need only take note of the identifying number on the identification plate of the post sleeve in which the supporting post is mounted, and relay the number to the appropriate authority. The database will provide such details as the text and size of the sign, the height of the post, the materials of the sign and post, and even the replacement history of that particular sign. The replacement sign can be assembled according to the specifications, and installed.

According to an embodiment, the identification plate 108 includes a bar code number, which simplifies the capture of the identification number, and prevents transcription errors. The operator, when recording the pertinent information, scans the bar code with a portable scanner, and then enters the associated data.

According to another embodiment, a radio-frequency identification (RFID) tag is provided, either as part of the identification plate 108, embedded in the body 116 of the post sleeve 102, or otherwise attached thereto. When an interrogation signal is transmitted from a nearby RFID reader, an antenna of the RFID tag collects power from the signal and activates a transmitter circuit that transmits the unique identification number of the respective post sleeve, which is received by the reader. As is well known in the RFID art, RFID tags can be extremely simple, providing only basic identification information, or can be more complex, comprising a non-volatile memory to store a significant amount of data, either in a read-only format or in a read-write format. Accordingly, in some embodiments, additional information that may be relevant to a particular application can be saved in the RFID tag of a post sleeve for later retrieval.

The term identification number is used broadly to refer to an identifying element that is unique to a single post sleeve and that distinguishes one post sleeve from other post sleeves. The identification number can be a string of letters, numbers, symbols, or a combination of elements. It can, for example, comprise a serial number applied to a post sleeve during fabrication, or a string of characters that includes additional information relative to the make or model of the post sleeve, or its date or place of manufacture.

Figure 7:
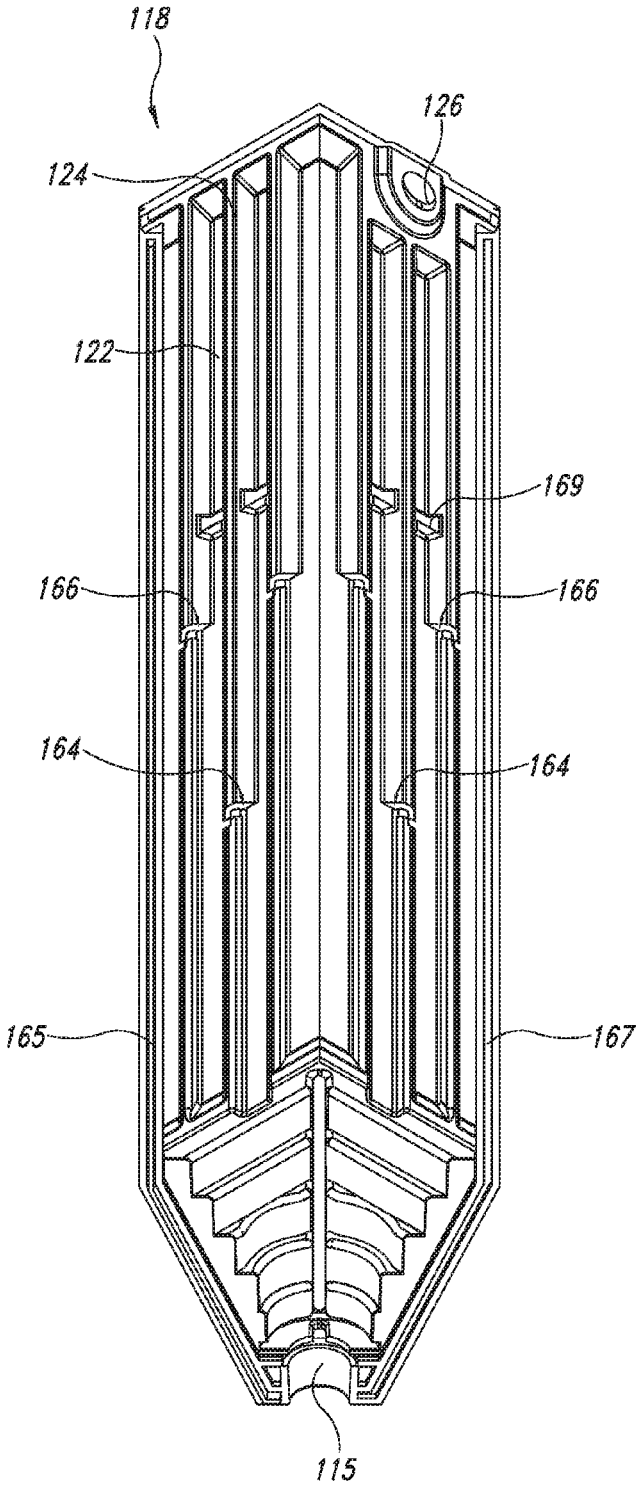
FIG. 7 shows a sleeve liner section according to an embodiment of the invention.

Referring now to FIG. 7, a single liner section 118 is shown, according to an embodiment in which the sleeve liner 120 comprises two substantially identical injection molded liner sections. The liner section 118 includes a tongue element 165 extending down the left edge, as viewed in the drawing, while a groove 167 extends down the right edge. When two such sections are positioned face-to-face, the tongue element 165 of one section engages the groove 167 of the other section, and vice-versa, permitting the two sections to be pressed or snapped together to form the sleeve liner 120. In the illustrated embodiment, the two sections snap together, although any appropriate fastening means can be used to couple the sections 118, including solvent or electronic welds, clips, tape, etc. It is only necessary that the two sections hold together while the concrete body 116 is cast around them to form a single integral unit.

As described above with reference to FIG. 6, the liner sections 118 include 13 inch stops 164 and 9 inch stops 166 configured to be engaged by the tabs of the respective stop plates to support a post at those depths below the rim of the post sleeve. In the embodiment pictured, two sets of stops are shown, but the invention is not limited to two sets of stops, or to the specific dimensions described. Liner sections can be provided with more or fewer sets, and according to some embodiments, there are none.

Detents 169 are provided to assist in installation of the post sleeve 102. According to an embodiment, the detents 169 are engaged by an installation mechanism configured to support the post sleeve from an overhead structure, so as to permit the sleeve to hang plumb at the desired height in the hole 138 while an installer pours the concrete footing. In this way, the post sleeve can, if required, be provided with a concrete footing that extends some distance below the sleeve without requiring support from below while the concrete footing cures, and can be properly oriented and plumbed.

While the sleeve liner 120 has been described in combination with a prefabricated concrete sleeve body, the sleeve liner 120 can be cast in place in a concrete footing, in the field, without the prefabricated body. For example, where the extreme longevity and other advantages afforded by the high-strength prefabricated body are not considerations, it may be advantageous to omit the body, and instead to position the sleeve liner 120 and pour the footing around it. In another example, where a large surface is to be paved, with a number of sleeves provided to support posts, e.g., to support a guardrail along a concrete walkway, the sleeve liners can be set directly in the concrete during the pour of the walkway to provide a clean and unified appearance.

Figure 10:
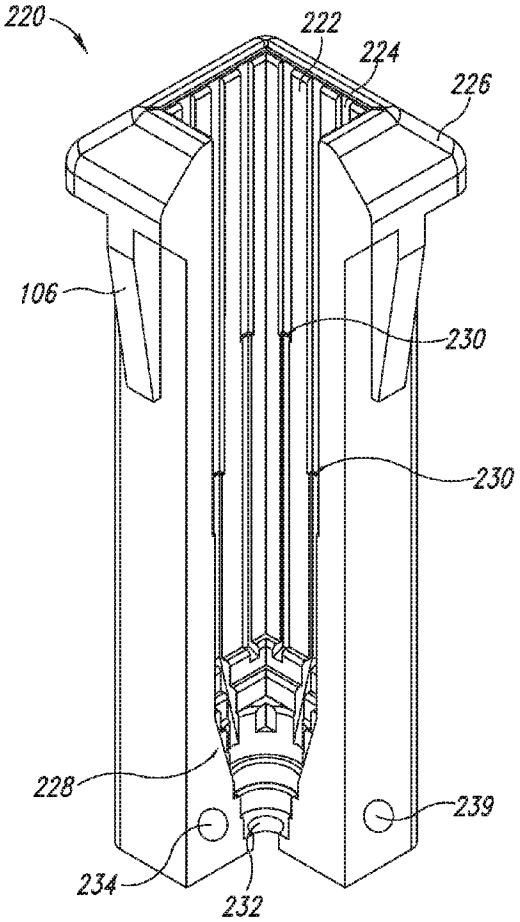

FIG. 10 shows an embodiment in which a post sleeve 220 is cast directly from concrete or other suitable material, without a separate liner. The post sleeve 220 includes ribs 222 and drain channels 224 that are substantially analogous in function to the standoff ribs 122 and drain channels 124 described with reference to FIGS. 2-7. A universal socket section 228 is provided, having individual sockets configured to receive posts of a variety of dimensions, much as described with reference to FIG. 5, and stops 230 are shown at various depths below the rim 226, as described with reference to FIGS. 6 and 7. A coupling configured to engage a drain hose can be press fitted or cast into the lower aperture 232 of the sleeve liner 220 during the casting process. Alternatively, the aperture can be left smooth, as shown in FIG. 10, and the drain hose affixed with a common construction adhesive, or the aperture 232 can be sized to receive the hose in an interference fit.

Also shown in FIG. 10, horizontal holes 234 are provided extending through the lower-most part of the post sleeve 220. In climates where annual freezing and thawing cycles might tend to lift the post sleeve 220 out of the ground, short pieces of rebar are positioned in the holes 234 to establish a more secure engagement between the post sleeve 220 and the concrete footing, to prevent uplift. In other cases, concrete that flows into the holes 234 during installation of the post sleeve 220 may be adequate to prevent uplift.

In many cases, it is not desirable to permit a wood post to directly contact the concrete of the post sleeve. Accordingly, where the post sleeve is cast without a separate sleeve liner, such as the embodiment of FIG. 10, an interior coating can be sprayed in, to isolate the post from the concrete. If necessary, at intervals over the life of the post sleeve, the coating can be re-sprayed at the same time that the post is replaced.

Figure 11:
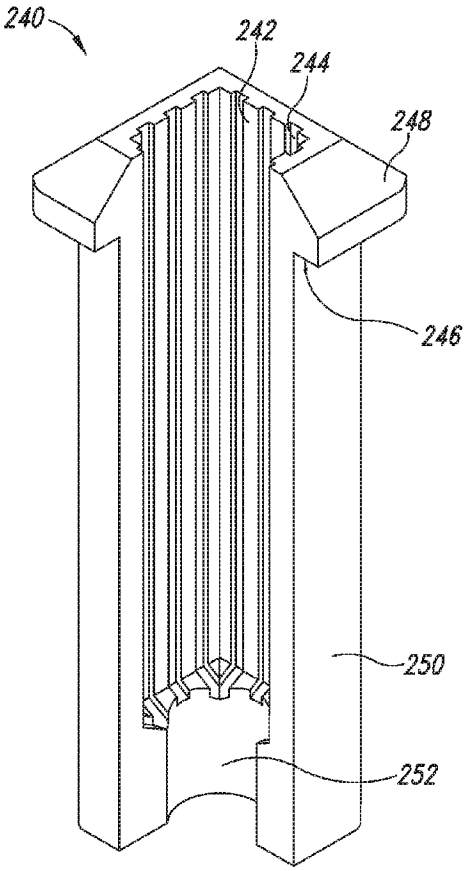
FIGS. 10 and 11 show post sleeves according to respective embodiments.

FIG. 11 shows a post sleeve 240 that, like the embodiment of FIG. 10, is cast directly from concrete or other suitable material, without a separate liner. The post sleeve 240 includes ribs 242 and drain channels 244, a lower aperture 252, a rim 248, and a lower body portion 250. The post sleeve 242 is configured to receive a single size of post, and does not include a universal socket section, nor stops. In certain high volume applications where a large number of post sleeves are required for a single size of post, it may be economically or structurally advantageous to manufacture a custom post sleeve configuration for that size. This may be true where, for example, because of the dimensions of the posts, stop plates and support plates would be required for each post sleeve, or where the anticipated lateral loads on the posts will possibly render standard stop and support plates inadequate.

Also shown in the embodiment of FIG. 11, it can be seen that the soffit 246 is substantially perpendicular to the vertical sides of the body 250, and that the sides of the lower body 250 do not include reinforcing ribs analogous to the ribs 106 of FIG. 1. This configuration is useful in applications where the soffit is intended to engage a supporting surface. For example, where a post is to be installed into a previously paved surface, an opening is cut in the pavement, with a size that is smaller than the outer dimensions of the rim 248 but large enough to receive the lower body 250. According to one embodiment, the lower body of the post sleeve is cylindrical, such that a circular hole only slightly larger than the lower body can be bored in the pavement and the underlying material so that the post sleeve can be dropped into the hole and will be adequately supported without a concrete footing. It may be advantageous to apply an adhesive between the soffit and the pavement to prevent prying up of the post sleeve, and to prevent water from entering the hole from the surface of the pavement.

Figure 12:
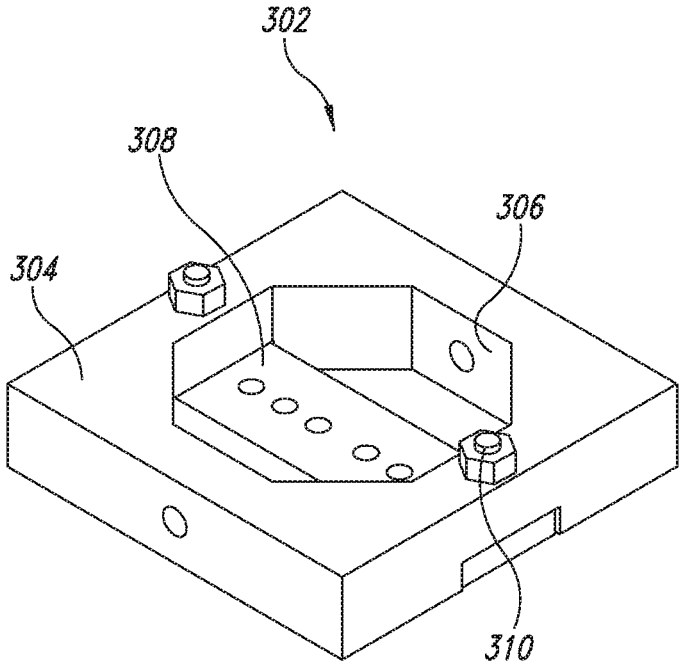
FIG. 12 shows a transition fitting for a post sleeve, according to an embodiment.

FIGS. 12-20 show details of post sleeve assemblies according to various embodiments. According to the embodiment of FIG. 12, a flange transition fitting 302 is provided, that is sized to fit an odd sized post, such as, for example, a 1½ inch square tube, or a metric tube, or an odd shaped post such as the hexagonal post shown in FIG. 12. In this way, a non-standard post can be installed in the closest appropriate socket of the universal socket section 151 of a post sleeve. The embodiment pictured in FIG. 12 is configured to fit in the 4×4 socket 150 of the post sleeve 102, and comprises a body 304 of UHMW polyethylene with a hexagonal socket 306 machined therein. A steel plate 308 is coupled to the body 304 by fasteners 310 to provide vertical support to a post, while the body and socket provide lateral support. Other fittings and plates, such as post collars, support plates, etc., or transition pieces configured to snap into standard fittings, can be produced in small volumes by standard machining methods, as previously described.

Figure 13:
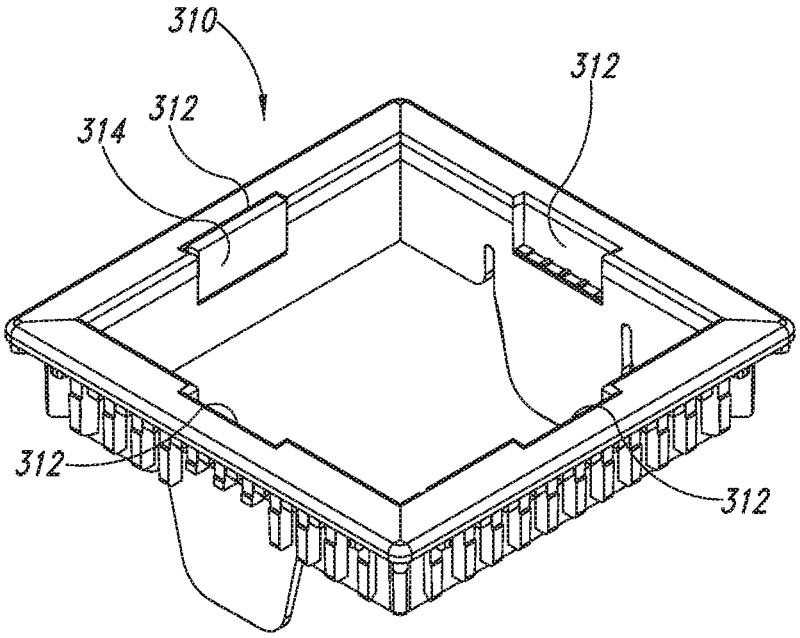
FIG. 13 shows a post collar with slots configured receive replaceable pesticide tablets, according to one embodiment.

FIG. 13 shows a post collar 310 with slots 312 configured receive replaceable pesticide tablets 314 to discourage harmful insects from entering the post sleeve. Because the tablets are positioned to place vapor or runoff precisely where it is required, within the enclosed space around the post and inside the drainage channels 124 and reservoir of the post sleeve 102, the tablet 314 can be configured to release very minute amounts of chemical over a prolonged period of time.

Figure 14:
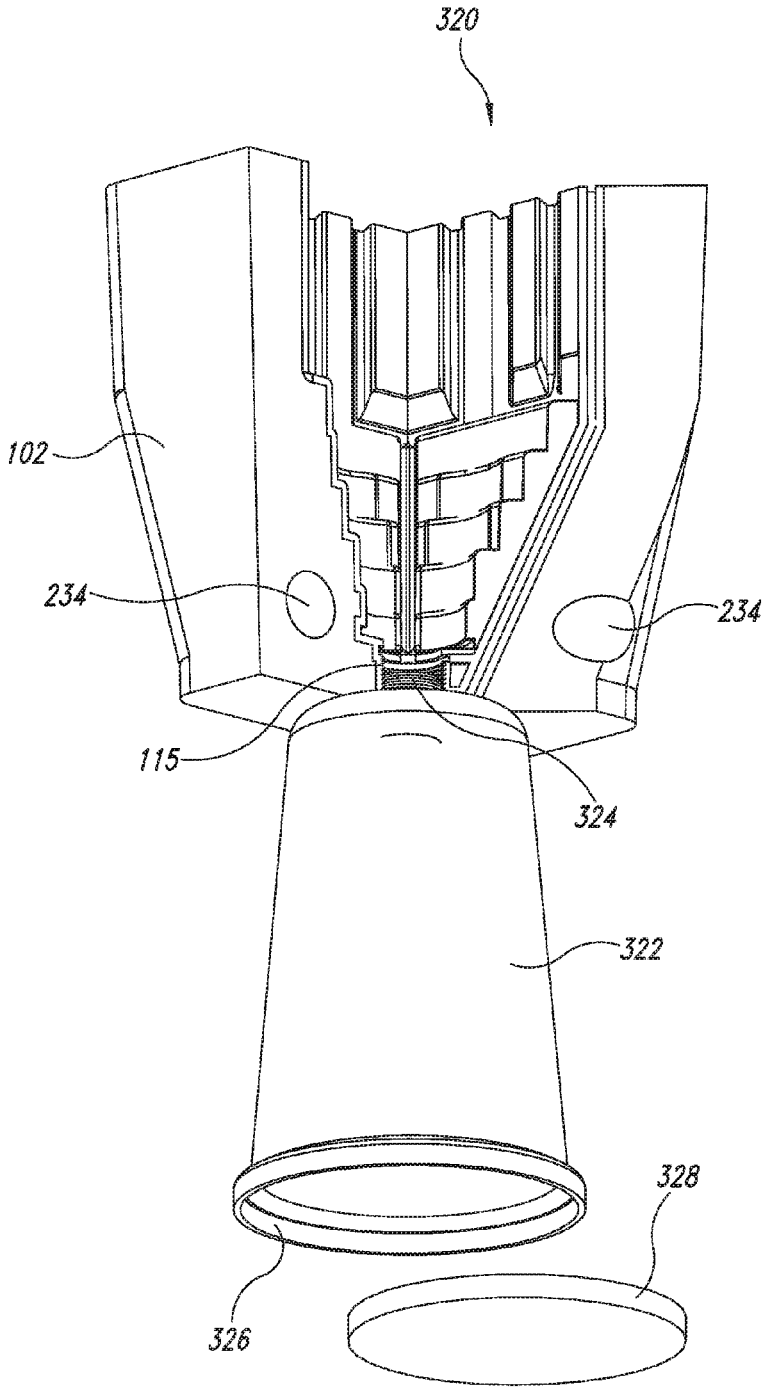
FIG. 14 shows a post sleeve assembly according to an embodiment.

FIG. 14 shows a sleeve assembly 320 that includes a reservoir 322 positioned beneath a post sleeve 102. The reservoir 322 includes a threaded neck 324 configured to engage threads in the aperture 115 of the post sleeve 102 or at the lower end of a drain hose, and has a large opening 326 configured to provide open contact with the surrounding concrete. A temporary barrier 328, such as a cardboard panel, is provided in an opening of the reservoir to prevent entry of concrete during the pour of the footing. The barrier 328 disintegrates the first time it is contacted by water, and thereafter does not impede contact of water with the concrete. The concrete of the footing surrounding the reservoir 322 is provided with a selected porosity, such as by controlled entrainment of air, to function as a slow-flow barrier, to permit very slow passage of water from the reservoir 322 to the surrounding soil. In some environments, there may be periods during which the water table rises near the surface, either seasonally, or in response to heavy rains. Sleeve assemblies that are configured to allow water to flow quickly out, may also allow water to flow quickly in when the water table rises above the lower aperture, which can subject the post to continuous contact with the water until the table drops again. The slow-flow barrier of concrete is configured to limit the passage of water so that days or weeks may be required for water to fill the reservoir 320, with the volume of the reservoir selected to accommodate water entering from the post sleeve 102 as well.

According to a related embodiment, a reservoir is provided that is covered with gravel or sand before the footing is pouring, and a slow-flow membrane is provided to regulate the flow of water into the reservoir from outside the post sleeve 102. The slow-flow membrane 326 can be formed by providing a plurality of openings of a selected size in the reservoir, or can be a material with a selected porosity positioned over an open bottom of the reservoir.

Figure 15A:
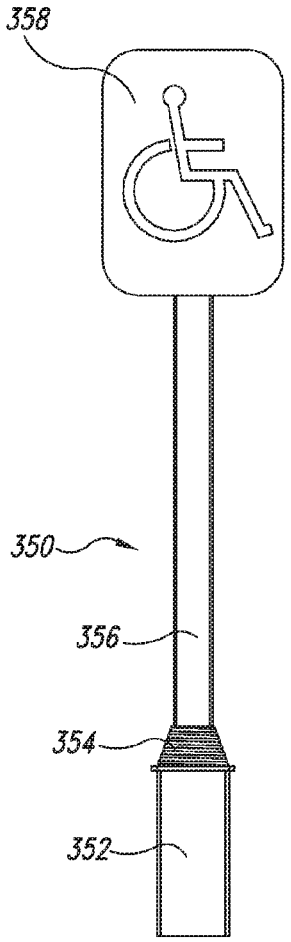
FIGS. 15A and 15B show a post assembly for use in applications where a post is likely to be contacted repeatedly by vehicles.
Figure 15B:
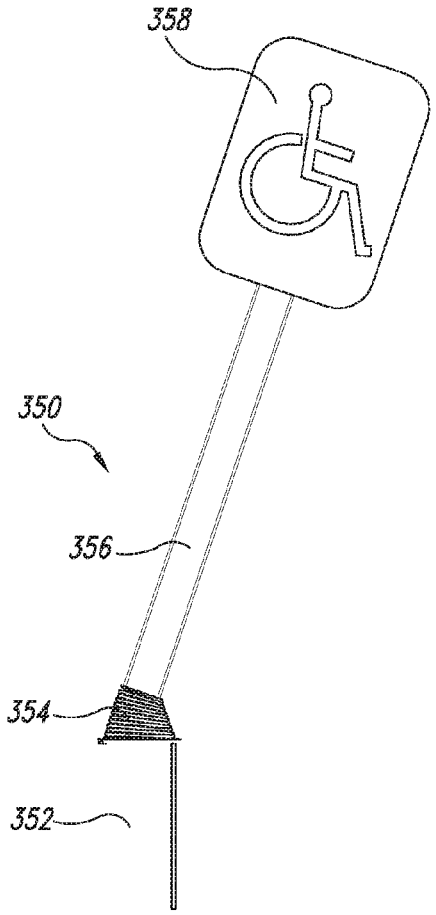

FIGS. 15A and 15B show a spring-loaded post assembly 350 for use in applications where a post is likely to be contacted repeatedly by vehicles, such as in parking lots, for example. The post 350 includes a sleeve engagement element 352 configured to be positioned within a 4×4 post sleeve. A stiff spring 354 is coupled to an upper end of the sleeve engagement element 352, and a post 356 configured to receive a sign 358 is coupled to an upper portion of the spring 354. Under normal conditions, the spring 354 holds the post 356 erect, as shown in FIG. 15A, but when subjected to the an impact, such as by a vehicle bumper, the spring 354 flexes, permitting the post 356 to yield to the impact, as shown in FIG. 15B, thereby avoiding damage.

Figure 16:
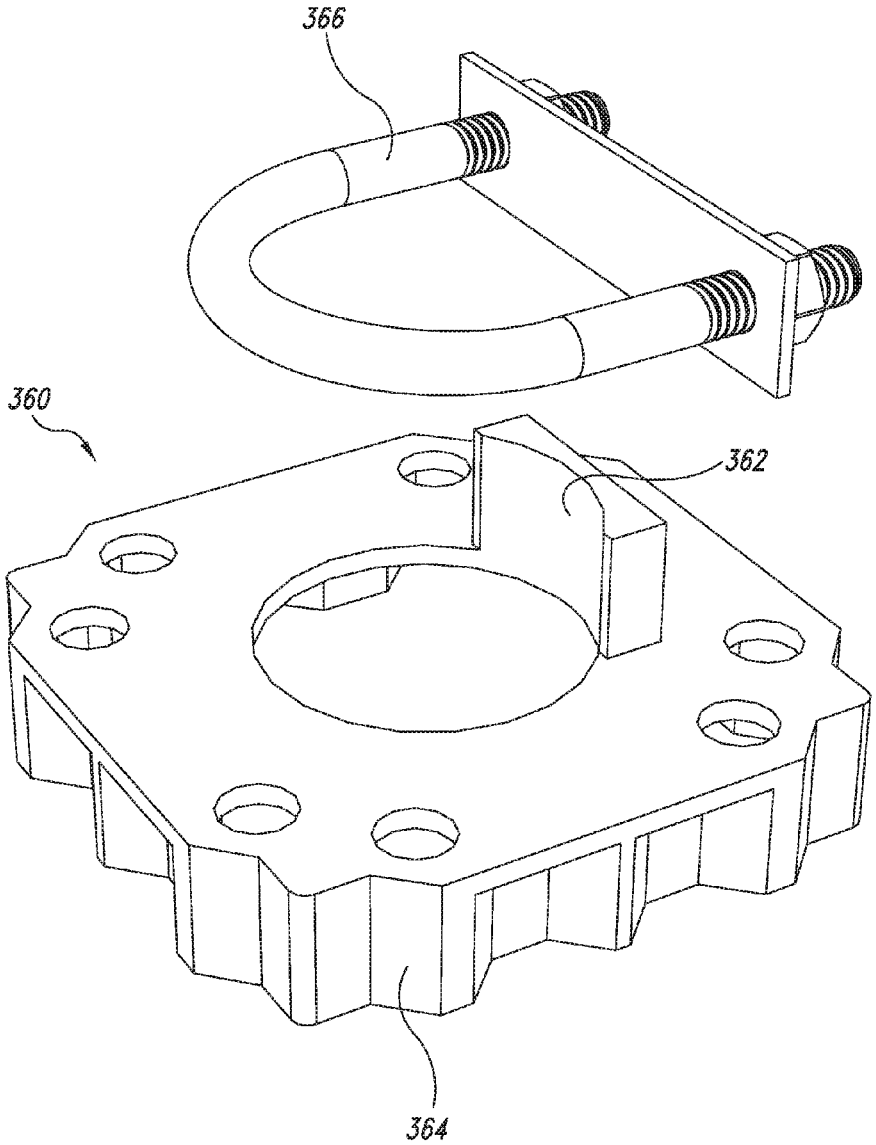
FIG. 16 shows a support plate for use with a round post, configured to prevent rotation of the post.

FIG. 16 shows a support plate 360 for use with round posts, and including a flange 362 that is configured to be engaged by a pipe clamp 364. When a round post is used to support a sign, for example, the sign may be prone to rotation around the longitudinal axis of the post because of wind forces against the sign face. The pipe clamp 364 firmly grips the post and the flange 362 of the support plate 360. Because the support plate is square, it cannot rotate within the post sleeve, and thus prevents rotation of the post. The support plate 360 includes extended sides 366 that engage the interior of the post sleeve over a substantial surface area to distribute the load and permit the inner surface of the post sleeve to tolerate the rotational forces transmitted by the support plate 360 without damage.

Figure 17:
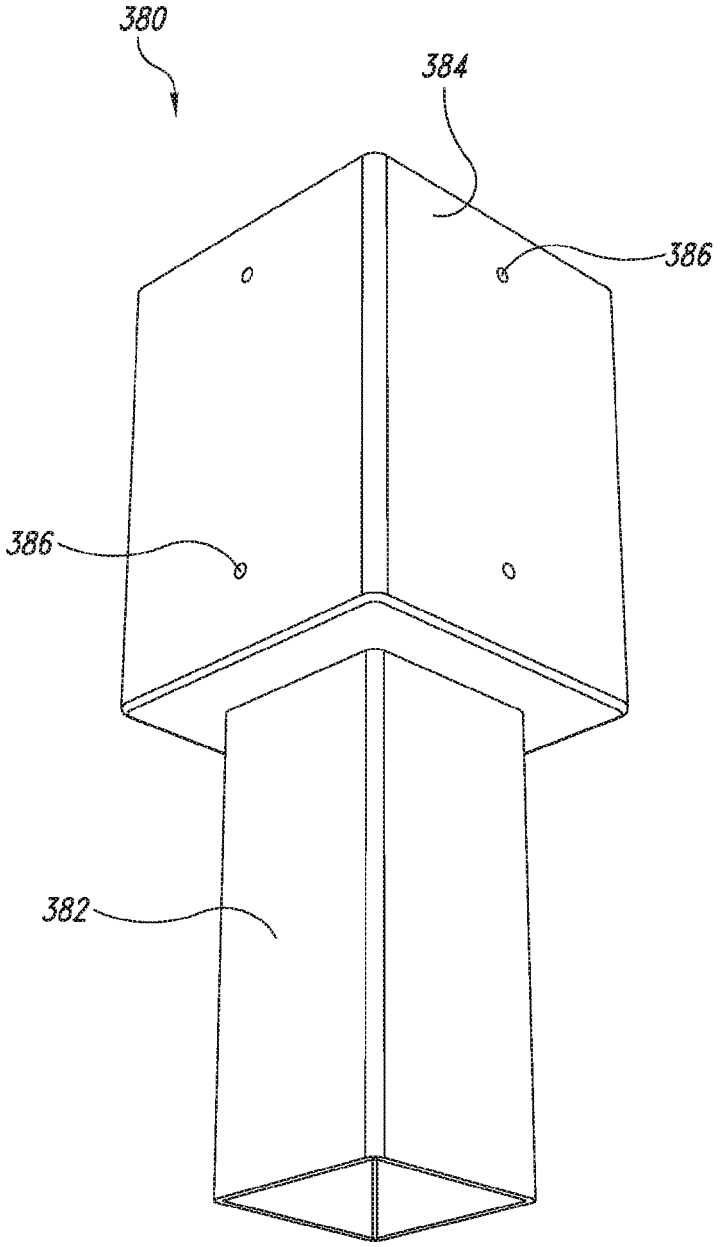
FIG. 17 shows an oversized post support according to an embodiment.

FIG. 17 shows an oversized post support 380 having a sleeve engagement element 382 configured to be positioned within a post sleeve. A post engagement element 384 of the post support 380 is configured to receive an oversized post having a size that is too large for the post sleeve. Holes 386 are provided for screws to permit secure attachment of a post to the post support. The sleeve engagement element 382 and post engagement element 384 of FIG. 18 are configured, respectively, to be received by a 4×4 post sleeve and to receive a 6×6 post, but this is only exemplary, and can be provided to meet a wide range of size requirements.

Figure 18:
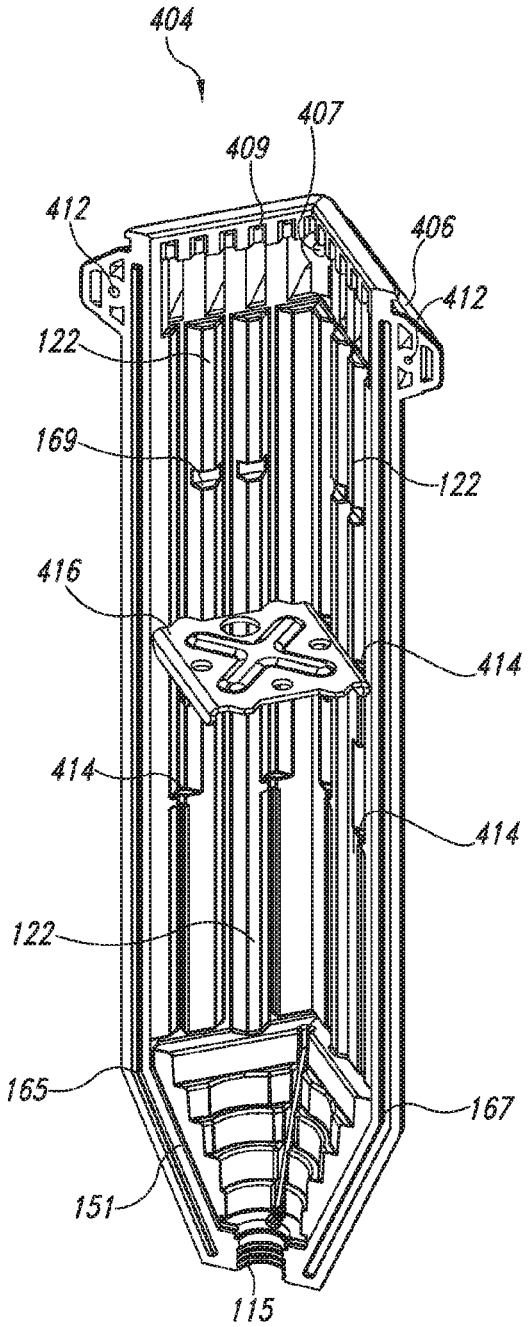
FIGS. 18 and 19 show a post sleeve according to an embodiment.
Figure 19:
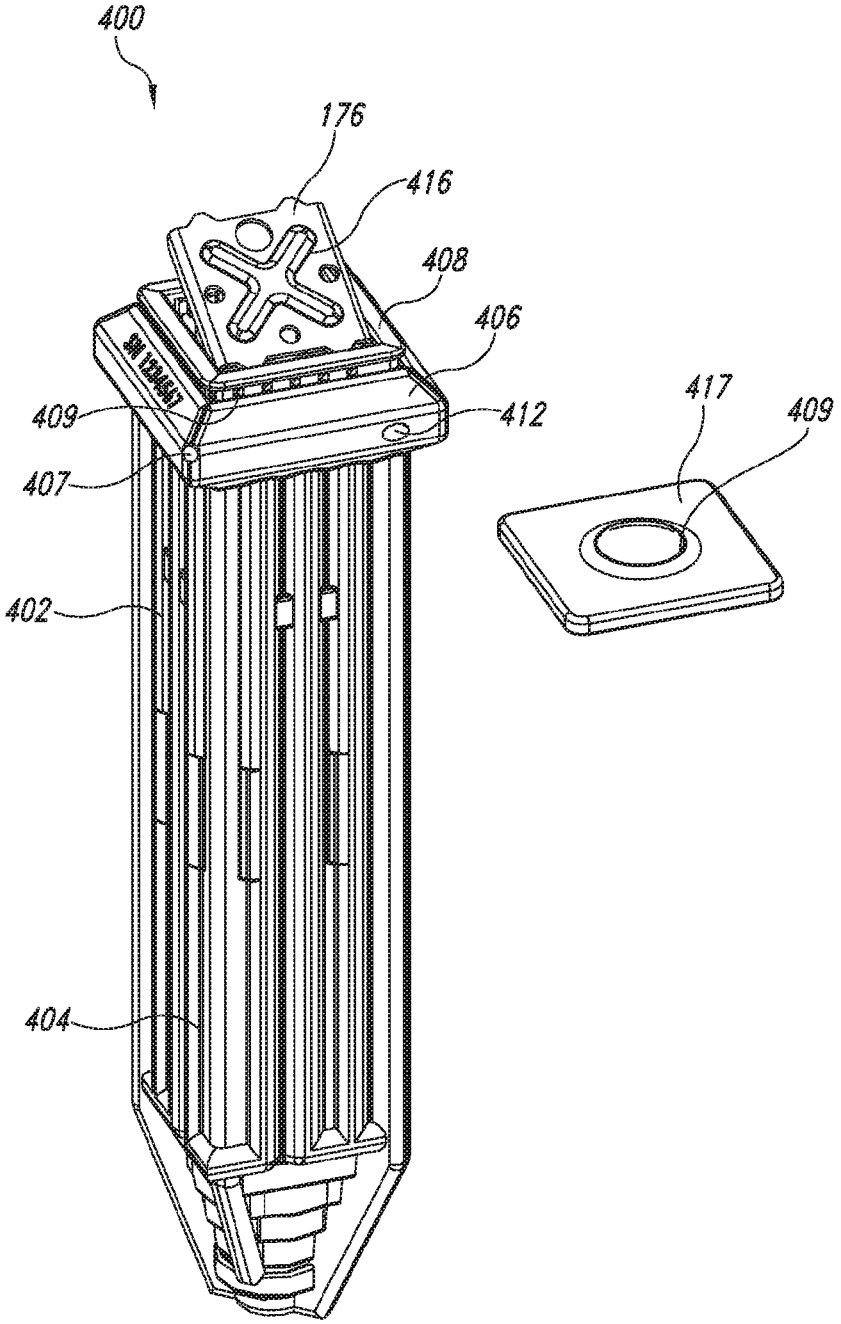

FIGS. 18 and 19 show a post sleeve 400 according to an embodiment in which the body 402 is formed of two identical sections 404. FIG. 18 shows a single section 404, while FIG. 19 shows the complete post sleeve 400 comprising two sections 404. The sections 404 are formed of an expanded plastic material and are manufactured by an injection molding process. The post sleeve 400 includes a rim 406 and post collar 408 formed integrally with the body 402 and defining an aperture 410 sized to fit closely around a post of a selected dimension—4×4 in the pictured embodiment. A cap 417 of a resilient material such as rubber is provided to fit over smaller sized posts and snap into place over the post collar 408 to prevent entry of water and debris into the post sleeve 400. In the example shown, the cap 417 has a round aperture 419 to fit over a 1⅞ inch round post. Apertures 409 under the post collar 408 permit ventilation, while the post collar 408 directs water onto the outwardly sloping rim 406. An aperture 407 is provided to receive a fastener 411 configured to engage and lock a post positioned in the sleeve, similar to the fastener described with reference to FIG. 4.

Stops 414 are provided at various depths within the post sleeve 400 for engagement by plates 416. Each plate 416 is provided with tabs 176 positioned on two opposing edges of the plate so as to engage opposing stops 414 and bridge across the interior of the post sleeve 400. In the transverse dimension the plates 416 are narrower so as to fit through the aperture 410 and between the standoff ribs 122 at an angle, as shown in FIG. 19, to enable positioning and removal of the plates 416. A plate 416 can engage stops 414 at any height by lowering the plate 416 into the post sleeve 400 at an angle and engaging the stops at a selected depth, first on one side, then allowing the plate to drop and engage the stops on the opposite side of the sleeve.

According to an embodiment, stops 414 on one face of each section 404 are positioned some distance above the stops on the adjacent face. When the sections are assembled together, the stops 414 directly opposite each other are at the same depth, while those on the transverse faces are at a different depth. Thus, the plate 416 can be positioned at any of a number of different depths by selecting the orientation of the plate as it is introduced into the sleeve, then selecting the set of stops to engage on a given pair of opposing faces.

The sections 404 are joined as described with reference to the sleeve sections 118 of FIG. 7, and also include apertures 412 configured to receive screws for secure coupling of the sections 404. The post sleeve 400 is configured to be set directly in a concrete footing without a separate concrete body, and is provided with thicker sidewalls than those of the liner 120 described in previous embodiments, which provide sufficient stiffness to resist the weight of wet concrete and prevent deformation of the body 402 during the pour of the footing. The post sleeve 400 provides, in a one-piece construction, many of the advantages described above with reference to other embodiments.

Figure 20:
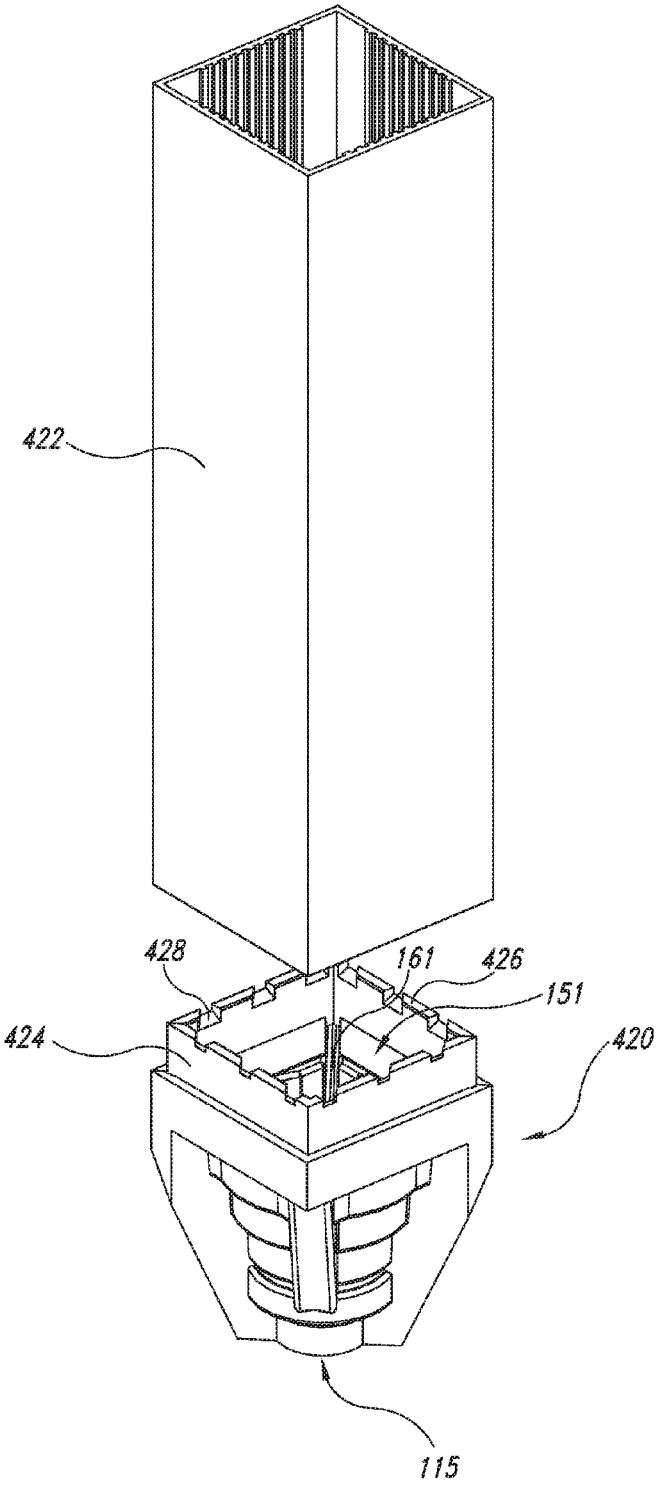
FIG. 20 shows an insert configured to engage a commercially available post sleeve section.

FIG. 20 shows an insert 420 that is configured to engage a commercially available post sleeve section 422. There are a number of post sleeves that are commercially available that provide some protection to posts set in concrete, such as, for example, the plastic sleeve 422 shown in FIG. 20. The sleeve 422, manufactured by PostShield USA™, is sized to receive a 4×4 post. It is manufactured using an extrusion process and is therefore very low in cost, but because of that process, is limited to a single continuous profile.

The insert 420 includes an engagement element 424 having outer dimensions that correspond to the size of a 4×4 post, and therefore fits into the lower end of the sleeve 422. The engagement element 424 includes a substantially planar top surface 426 with a plurality of notches 428. The insert 420 is provided with an aperture 115 to permit water to drain via a drain hose, etc., while preventing direct contact of the post with concrete or the underlying soil. Additionally, a universal socket section 151 is provided, similar to that described with reference FIG. 4, which enables a user to convert the commercial post sleeve 422 for use in other configurations. The insert 420 is formed of an expanded plastic such as that described with reference to the embodiment of FIG. 19, and can be manufactured in a single piece or two identical halves.

A user positions the insert 420 in the lower end of the post sleeve section 422 and fixes the combined assembly in the ground according to the requirements of the particular application. Typically, the engagement element 424 engages the sleeve section 422 with an interference fit that is sufficient to hold the assembly together until it is emplaced, especially if it is to be fixed in a concrete footing. However, if necessary, the insert 420 can be fixed to the sleeve through the use of commercial adhesives, tape, or screws. When a post is positioned in the sleeve section 422, the bottom end of the post rests on the top surface 426, if it is a 4×4 post, or in the appropriate one of the sockets of the universal socket section 151, according to its dimensions. As with the post sleeves of other embodiments, water that enters the sleeve 422 is permitted to drain from the assembly, via the notches 428, gutters 161 of the universal socket section 151, and the aperture 115.

In addition to the advantages outlined above, a number of advantages are afforded in accordance with various embodiments. For example, post sleeves permit the temporary removal and replacement of posts. It is not uncommon for an individual to find it necessary to remove a section of a fence in order to move a vehicle or temporarily permit access to a normally enclosed area. Under such circumstances, where previously it might have been necessary to dig up two or three posts with their concrete footing, a user can simply pull the posts out of the sleeves and re-install them later.

Because of the protection from water damage provided by the post sleeves, the serviceable lifespan of wood posts is extended. Additionally, lower grades of wood, or more cheaply and environmentally friendly finished wood can be used without sacrificing durability.

Because of the stops and stop plates, shorter posts can be substituted for longer ones with no loss of structural strength. At the lumber mills, the shorter the length of the posts being cut the greater the yield from a given trunk, and the more economical. For example, due to the tapered shape of the trees from which most lumber is produced, there are increased efficiencies obtained if shorter lengths of material are cut therefrom. While eight-foot lengths are the most commonly used, mills inevitably produce shorter lengths, as well, either as leftover sections after a length has been cut into eight-foot pieces, or because, when setting out to produce eight-foot posts, many of the pieces generated will need to be trimmed back due to end defects. Thus, mills generally have a surplus of lumber shorter than eight feet in length, because standard methods of construction require the eight-foot lengths, making the shorter timbers less marketable. By employing post sleeves to anchor the fence posts, seven-foot lengths can be used, which, because of their availability and recovery, are less expensive per linear foot than eight-foot lengths and are more environmentally friendly. Furthermore, even if demand for seven-foot lengths of fence posts increases beyond the surplus currently available, the price will inherently remain lower because of the better yield of shorter posts from a given length of tree, as explained above. Due to the improved economy with respect to both yield and trim backs, mills can sell 7 foot material for substantially less per linear foot and produce it in a more environmentally friendly way than the 8 foot material.

Many of the advantages outlined above contribute to a significant reduction in overall environmental impact: the ability to use shorter posts for a given size means a higher yield per trunk and less scrap, which in turn means that fewer trunks need be cut to produce a given number of posts; the increased useful service life of a post means fewer replacement posts need be provided, further reducing consumption; protection of the post from water and most insects means that pressure treatment is no longer necessary, which reduces chemical pollution and also enables composting or recycling of the used posts, and which also potentially reduces the load on solid waste landfills currently necessary to dispose of pressure treated lumber; the permanent, long lasting post sleeve eliminates the need to dig up and dispose of old concrete footings, and the need to replace the concrete footing with new concrete; which means a long-term reduction in high energy consumption required to produce the cement of the replacement concrete; the compatibility of the post sleeve with a wide range of post configurations means that a change in function that requires a change in post height or size does not necessarily require a replacement of the concrete footing; and the tracking of application data associated with the identification numbers means that large fence sections can be manufactured to order in a shop or factory rather than on site, which results in fewer lifetime site visits, less overall fuel consumption, and less material waste, which further reduces the consumption of raw materials.

Embodiments of the invention are directed to devices configured to support posts, e.g., fence posts, sign posts, etc. Accordingly, many of the elements are described and claimed with reference to a post. For example, in describing the standoff ribs 122 of FIG. 2, the post sleeve 102 is described above as functioning "as an extension of the post." Nevertheless, unless a claim positively recites a post as an element of the claim, reference in a claim to a post is to be construed only as defining the recited element as it relates to a post, and is not to be construed as requiring the post. Therefore, if such a claim reads on a given device with a post, it will also read on the device in the absence of the post.

When used in the specification or claims to refer to a post sleeve assembly or elements thereof, terms that refer to a relative vertical position, such as upper, lower, above, below, top, bottom, etc., are to be construed according to the normal orientation of the referenced element in use, i.e., with an associated post sleeve oriented to support a post vertically—see, for example, the post sleeve assembly 100 of FIG. 3. Terms such as inside, outside, inner, and outer are used with reference to an element's position relative to a central axis of an associated post sleeve. Terms that refer to an element's relative horizontal position, such as right and left, are used for convenience and clarity in the description, and do not limit the scope of the claims. The term longitudinal refers to an aspect of an element along its major or central axis. For example, the longitudinal dimension of the post sleeve 102 is the dimension from the top to the bottom of the post sleeve, as viewed in the figure. Transverse refers to an aspect of an element along an axis or in a plane that is perpendicular to the element's major axis.

Ordinal numbers, e.g., first, second, third, etc., are used in the claims merely for the purpose of clearly distinguishing between claimed elements or features thereof. The use of such numbers does not suggest any other relationship, e.g., order of operation or relative position of such elements. Furthermore, ordinal numbers used in the claims have no specific correspondence to such numbers used in the specification to refer to elements of disclosed embodiments on which those claims may read.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

Individual elements of the various embodiments described above can be omitted or combined with elements of other embodiments to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A post sleeve, comprising:

a body of a material that is substantially impervious to water;

a cavity extending through the body along a central longitudinal axis of the body from an upper aperture at an upper end of the cavity to a lower aperture at a lower end of the cavity;

a first socket positioned in the cavity near the lower end of the cavity and arranged coaxially with the central longitudinal axis of the body, the first socket having a square cross-sectional shape in a first plane perpendicular to the central longitudinal axis of the body and configured to receive a bottom end of a square post having a square cross-sectional shape;

a second socket positioned in the cavity near the lower end of the cavity and arranged coaxially with the central longitudinal axis of the body below the first socket, the second socket having a circular cross-sectional shape in a second plane perpendicular to the central longitudinal axis of the body and configured to receive a bottom end of a circular post having a circular cross-sectional shape; and a drain gutter that extends through the first socket and through the second socket.

2. The post sleeve of claim 1, further comprising a plurality of standoff elements extending inward from inner walls of the cavity, innermost surfaces of the plurality of standoff elements collectively defining, at a plurality of depths within the cavity, an inner space having dimensions of a selected size.

3. The post sleeve of claim 2 wherein the standoff elements are spaced apart from the first and second sockets to provide a drainage passage.

4. The post sleeve of claim 1, further comprising a plurality of stops extending inward from inner walls of the cavity and having a bearing surface lying substantially in a plane lying perpendicular to the central longitudinal axis of the cavity.

5. The post sleeve of claim 1 wherein the first and second sockets each include a respective ledge to support a bottom of the post and each include a respective sidewall to support a side of the post.

6. The post sleeve of claim 5 wherein the respective sidewalls of each of the first and second sockets are tapered.

7. The post sleeve of claim 1, further comprising an identifier coupled to the body and uniquely differentiating the post sleeve from other post sleeves.

8. The post sleeve of claim 1, further comprising a drain tube having first and second ends, the first end of the drain tube being coupled to the lower aperture such that fluid exiting the cavity passes into the drain tube.

9. A post sleeve, comprising:

a body of a material that is substantially impervious to water;

a cavity extending through the body along a central longitudinal axis of the body from an upper aperture at an upper end of the cavity to a lower aperture at a lower end of the cavity;

a first socket positioned in the cavity near the lower end of the cavity and arranged coaxially with the central longitudinal axis of the body, the first socket having a square cross-sectional shape in a first plane perpendicular to the central longitudinal axis of the body and configured to receive a bottom end of a square post having a square cross-sectional shape;

a second socket positioned in the cavity near the lower end of the cavity and arranged coaxially with the central longitudinal axis of the body below the first socket, the second socket having a circular cross-sectional shape in a second plane perpendicular to the central longitudinal axis of the body and configured to receive a bottom end of a circular post having a circular cross-sectional shape;

a third socket positioned in the cavity near the lower end of the cavity and arranged coaxially with the central longitudinal axis of the body, the third socket having a square cross-sectional shape in a third plane perpendicular to the central longitudinal axis of the body and configured to receive a bottom end of a square post having a square cross-sectional shape; and a fourth socket positioned in the cavity near the lower end of the cavity and arranged coaxially with the central longitudinal axis of the body, the fourth socket having a circular cross-sectional shape in a fourth plane perpendicular to the central longitudinal axis of the body and configured to receive a bottom end of a circular post having a circular cross-sectional shape.

10. The post sleeve of claim 9 wherein the first and the third sockets are above the second and the fourth sockets.

11. The post sleeve of claim 10 wherein the first and the third sockets are larger than the second and the fourth sockets.

12. The post sleeve of claim 11 wherein the first socket is above and larger than the third socket and the second socket is above and larger than the fourth socket.

13. The post sleeve of claim 9, further comprising:

a fifth socket positioned in the cavity near the lower end of the cavity and arranged coaxially with the central longitudinal axis of the body, the fifth socket having a square cross-sectional shape in a fifth plane perpendicular to the central longitudinal axis of the body and configured to receive a bottom end of a square post having a square cross-sectional shape; and a sixth socket positioned in the cavity near the lower end of the cavity and arranged coaxially with the central longitudinal axis of the body, the sixth socket having a circular cross-sectional shape in a sixth plane perpendicular to the central longitudinal axis of the body and configured to receive a bottom end of a circular post having a circular cross-sectional shape.

14. The post sleeve of claim 13 wherein the first, third, and fifth sockets are above the second, fourth, and sixth sockets.

15. The post sleeve of claim 14 wherein the first, third, and fifth sockets are larger than the second, fourth, and sixth sockets.

16. The post sleeve of claim 15 wherein the first socket is above and larger than the third socket, the third socket is above and larger than the fifth socket, the second socket is above and larger than the fourth socket, and the fourth socket is above and larger than the sixth socket.

17. The post sleeve of claim 16 wherein a width of the fifth socket has a length and the second socket has a diameter that is equal to the length.

* * * * *